United States Patent [19]

DiMatteo

[11] 4,016,005

[45] Apr. 5, 1977

[54] METHOD OF TRANSFERRING A PERSON FROM A RECLINED POSITION TO A SEATED POSITION

[75] Inventor: Paul L. DiMatteo, Huntington, N.Y.

[73] Assignee: Dynell Electronics Corporation, Melville, N.Y.

[22] Filed: Jan. 28, 1975

[21] Appl. No.: 544,710

[52] U.S. Cl. ..... 134/30; 4/7; 4/251; 5/81 R; 5/90; 134/32; 297/DIG. 4; 297/DIG. 10

[51] Int. Cl.[2] ..... A61G 7/02; A61G 7/10; B08B 3/02

[58] Field of Search ..... 134/30, 32; 5/60, 62, 5/66, 69, 81 R, 81 B, 90, 91, 332; 297/68, DIG. 4, DIG. 10; 4/7, 134, 185 L, 240, 251, 254

[56] References Cited

UNITED STATES PATENTS

| | | | |
|---|---|---|---|
| 1,529,699 | 3/1925 | Hawk | 5/62 X |
| 3,149,349 | 9/1964 | Nelson | 5/66 |
| 3,224,016 | 12/1965 | Anderson et al. | 5 81 R X/ |
| 3,285,619 | 11/1966 | Kitrell et al. | 5/81 R X |
| 3,312,985 | 4/1967 | Callaghan | 5/66 |
| 3,473,174 | 10/1969 | Cool | 4/251 |
| 3,503,083 | 3/1970 | Barnett | 5/90 |
| 3,545,015 | 12/1970 | Richardson, Jr. et al. | 4/7 |

*Primary Examiner*—Robert L. Lindsay, Jr.
*Assistant Examiner*—Richard J. Fisher
*Attorney, Agent, or Firm*—Max Fogiel

[57] ABSTRACT

An arrangement which allows patients confined to their beds, to use a toilet without leaving their beds. A sectionalized mattress is positioned in sequential steps so as to place the patient directly over a toilet without discomfort to the patient. The mattress together with the patient is positiond in a manner which allows the patient to use the toilet while sitting in an upright customary manner. The section of the mattress over the toilet is removed while the patient's weight is not directed thereon. Hygienic cleansing procedures are provided in conjunction with the toilet, and the patient is returned to a reclined position after repositioning the mattress and replacement of the section of the mattress that was removed to enable the patient to use the toilet. Replacement of that section of the mattress is carried out also while the patient's weight is not directed thereon. The mattress is positioned through a similar sequence of steps to place the patient directly into a wheelchair.

23 Claims, 26 Drawing Figures

144
136
148
140
142
146
138
134
46
52
68
54a
36
48
50
64
34
40
54
32
156
62
44
60
56
70
42
66
38

METHOD OF TRANSFERRING A PERSON FROM A RECLINED POSITION TO A SEATED POSITION

BACKGROUND OF THE INVENTION

Toilet apparatus intended for persons generally confined to their bed, is already known in the art. However, the conventional apparatus which is available, heretofore, is not comfortable to the patient, does not allow the patient to use the toilet in the normal customary manner, and often requires that the patients leave their beds.

Conventional devices often used for patients are bedpans. These irritate the skin of the patient, and do not allow the patient to sit upright in the desired normal customary manner. Other conventional devices known in the art require that the patients be displaced relative to their beds, or leave their beds, in order to enable them to use the toilet in a seated normal upright position. Still other apparatus available in the art require that hospital aides, for example, exert considerable effort and carry out laborious procedures to apply the apparatus to the patient for use. This is often particularly uncomfortable to the patient, and requires that the aides possess substantial physical strength to carry and position the patient. The apparatus, furthermore, does not include provisions for hygienic cleansing and leaves the patient often in discomfort.

In addition to the disadvantages inherent in the conventional apparatus or hospital bed, these do not include provisions for transferring a patient from the bed to a wheelchair without requiring attendants to remove the patient from the bed and carry the patient into the wheelchair when the patient does not have, for example, sufficient muscle control or strength.

Accordingly, it is an object of the present invention to provide an arrangement which permits bedridden patients to use a toilet in a seated normally upright position, without leaving their beds.

It is another object of the present invention to provide a toilet arrangement which permits patients to use a toilet without leaving their beds, and without requiring that the patients exert substantial effort in becoming positioned over the toilet.

A further object of the present invention is to provide a toilet arrangement of the foregoing character which applies hygienic cleansing to a patient after use of the toilet.

It is also an object of the present invention to provide an arrangement in conjunction with the toilet apparatus, which enables a patient to be placed directly into a wheelchair from the bed, without requiring that the patient be carried into the wheelchair or that the patient take physical steps to be seated into the wheelchair.

It is a particular object of the present invention to provide the foregoing arrangement for placing a patient over a toilet or into a wheelchair, in which the patient cannot exert any movements due to, for example, lack of muscle control or physical strength.

A still further object of the present invention is to provide an arrangement as described, which is simple in design, requires no special skill to use or operate, and may be maintained economically in service.

SUMMARY OF THE INVENTION

The objects of the present invention are achieved by providing an arrangement in which the patient's mattress is subdivided into essentially three sections. The three sections are rotatably displaced relative to each other to enable removal of the central section prior to the patient's use of the toilet. The central section is removed after the remaining two sections are positioned relative to each other in a manner so that the weight of the patient is not directed onto the area of the central section. After removal of the central section, a toilet seat is placed against the patient, and the assembly of the remaining two mattress sections together with the toilet seat supporting the patient are rotated and displaced so that the patient becomes located directly over a toilet, without requiring that the patient be shifted relative to the mattress sections. The patient is placed over the toilet in a seated upright or erect manner with feet directed downward in the normal customary manner of using a toilet.

After the patient has completed use of the toilet, and hygienic cleansing means has been activated, the patient together with the two sections of the mattress are rotated and displaced to enable replacement of the central section while the weight of the patient is directed away from that section. Thereafter, all three sections of the mattress are rotated and displaced to return the patient to a reclined position in which the three sections of the mattress are substantially coplanar.

In a further embodiment of the present invention, the three sections of the mattress carrying the patient are displaced relative to each other to the position in which the central section is removed as described above. After removal of this central section, a wheelchair instead of a toilet seat is raised and rotated in position so that the seat of the wheelchair is brought into contact with the area of the patient exposed through the removal of the central section. The wheelchair with the patient seated thereon is then rotated and lowered to the ground by passing through the movements substantially carried out for placing the patient over the toilet. Once the wheelchair together with the patient seated thereon is placed on the ground, the wheelchair may be used in the conventional manner.

The novel features which are considered as characteristic for the invention are set forth in particular in the appended claims. The invention itself, however, both as to its construction and its method of operation, together with additional objects and advantages thereof, will be best understood from the following description of specific embodiment when read in connection with the accompanying drawings.

DESCRIPTION OF THE PREFERRED EMBODIMENTS

Figure 1:
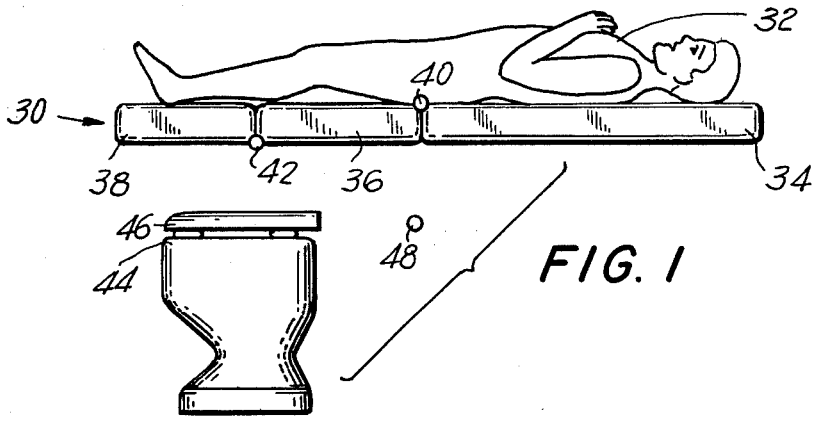
FIGS. 1 to 5 are schematic diagrams and show the relative positions of the essential elements in carrying out the sequence of operation, in accordance with the present invention.

Referring to the drawing, FIGS. 1 to 5 illustrate schematically the steps of moving a patient from a reclined position to a position in which the patient is seated over the toilet. In accordance with this arrangement of the present invention, a mattress 30 carrying a patient 32 is subdivided into essentially three sections comprised of a head section 34, central section 36, and foot section 38. The three sections are pivotable about pivots 40 and 42.

In the normal or usual position of the mattress 30, sections, 34, 36 and 38 are coplanar, as shown in FIG. 1, and the patient may lie thereon in a reclined manner.

Figure 2:
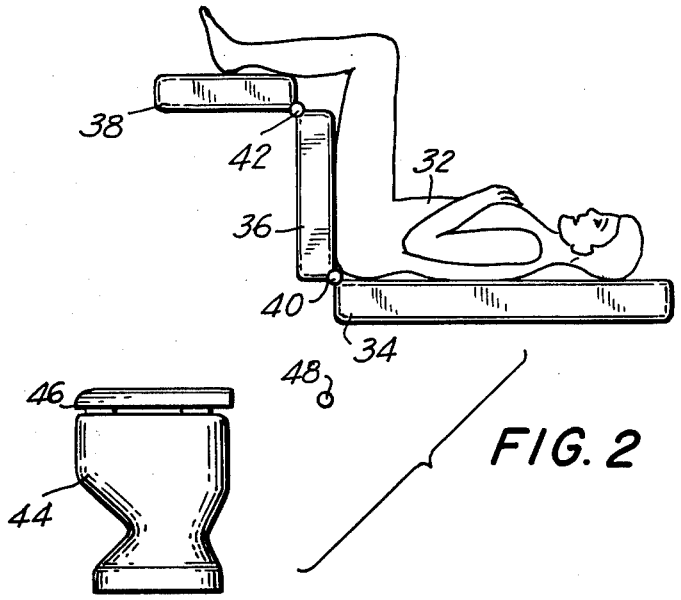

To carry out the procedure for placing the patient over a toilet 44 located beneath the mattress 30, the central section 36 is rotated relative to the head section 34 about pivot 40, into the position shown in FIG. 2. When section 36 is rotated substantially 90° about pivot 40 with respect to section 34, section 38 becomes rotated substantially 90° with respect to section 36, so that the patient lies in the position shown in FIG. 2 with feet supported upwards by the section 38, and head and back lying downward on section 34.

Figure 3:
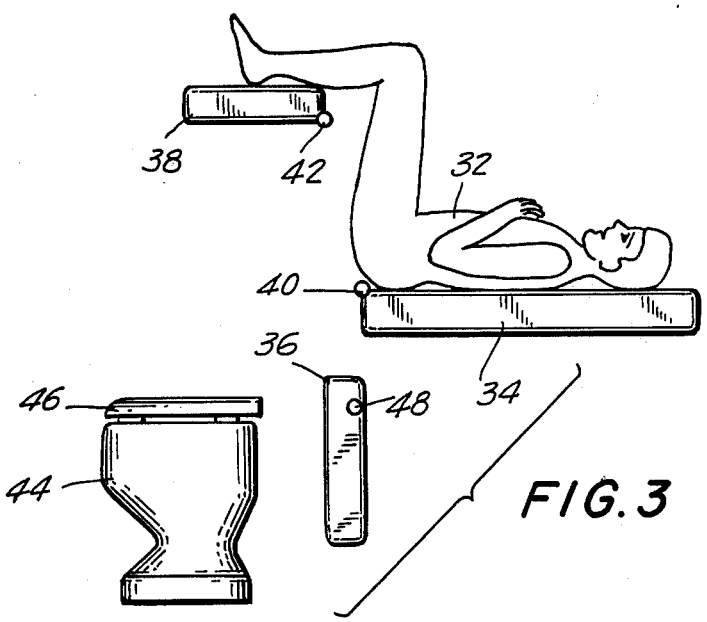

After the configuration of FIG. 2 has been attained, the central section of the mattress 36 is lowered to a position shown in FIG. 3, for the purpose of uncovering the area of the patient's posterior.

Figure 4:
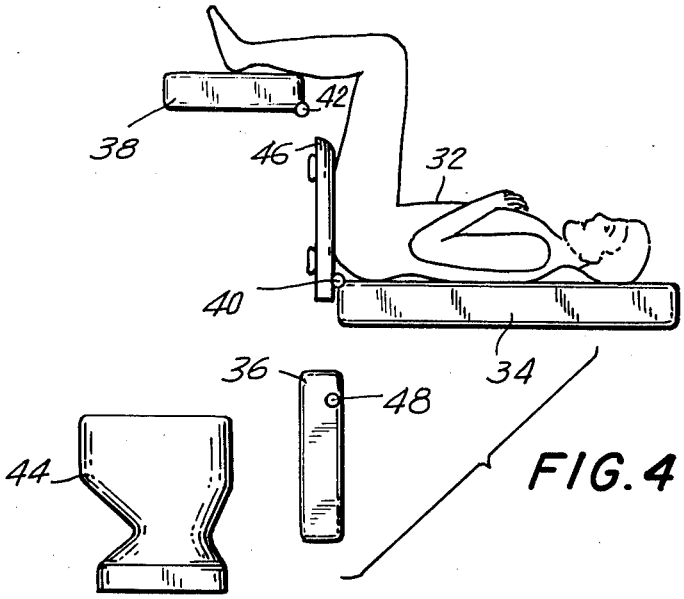

A toilet seat 46 resting normally on the toilet 44 is then rotated about a pivot 48 to bring the toilet seat 46 into contact with the patient's posterior as shown in FIG. 4. The linkage connecting the toilet seat 46 to the pivot 48 has been omitted from the schematic illustrations of FIGS. 1 to 5 for the purpose of clarity. The details of this linkage will be described subsequently.

Figure 5:
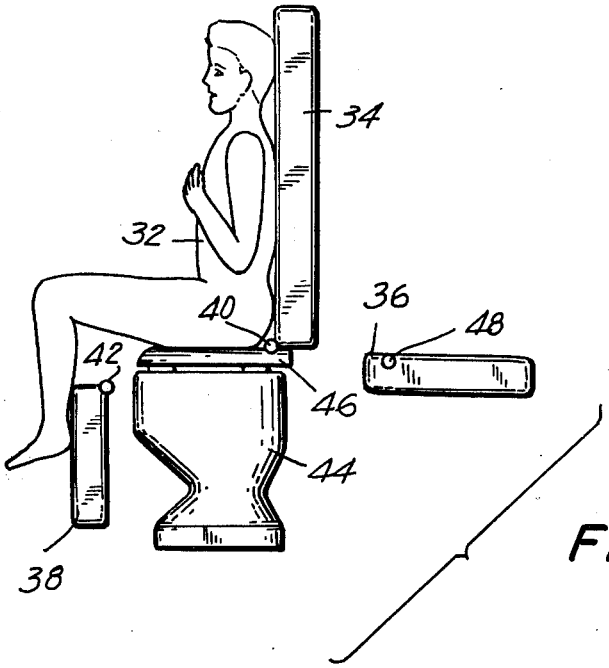

With the patient lying comfortably in the position shown in FIG. 4, the entire assembly of mattress sections 34, 36, 38 together with toilet seat 46 are rotated about the pivot 48 until the toilet seat 46 comes into contact with the top rim of the toilet 44, as shown in FIG. 5. In this position of FIG. 5, the patient is seated directly on the toilet in an upright and comfortable manner.

After the patient has terminated the use of the toilet, hygienic cleansing apparatus which may be installed directly within the toilet, may be actuated. Thereafter, the patient may be returned to a reclined position by passing through the sequence of FIGS. 4, 3, 2 and 1 in this specific reverse order.

Figure 6:
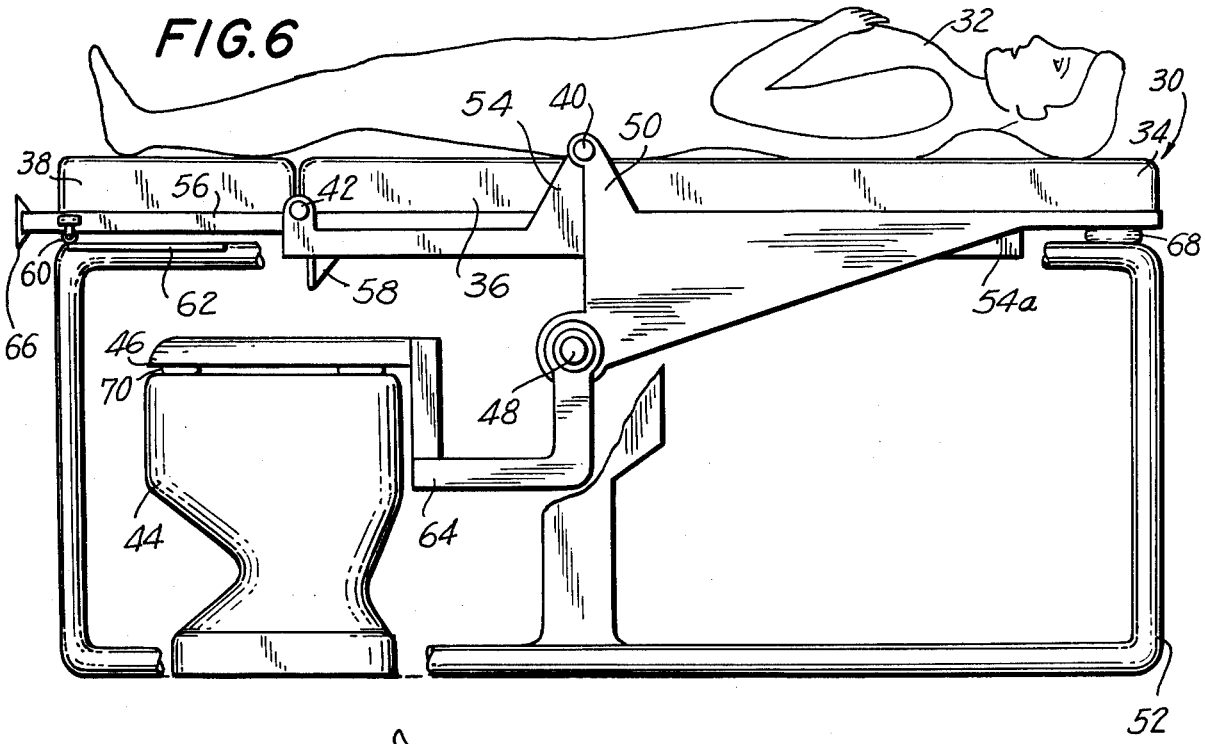
FIG. 6 is a side elevational view and shows the normal position of the arrangement of the present invention, with the patient in reclined position.

Referring to FIG. 6 for the further construction of the arrangement, in accordance with the present invention, the head mattress section 34 is held within a frame member 50 linked to pivot 40 and is pivotable thereabout. The frame member 50 is supported by a main stationary frame 52.

The central mattress section 36 is held by a frame 54 also linked to the pivot 40 for pivoting thereabout relative to the frame member 50.

The foot section 38 of the mattress 30 is held in a further frame member 56 which is pivotable about pivot 42, relative to the frame member 54. The latter holds the pivot 42 about which frame member 56 is rotatable. The toilet 44 is located beneath the mattress section 36 and 38 when the latter are in the positions shown in FIG. 6 wherein the patient is in reclined position.

Figure 7:
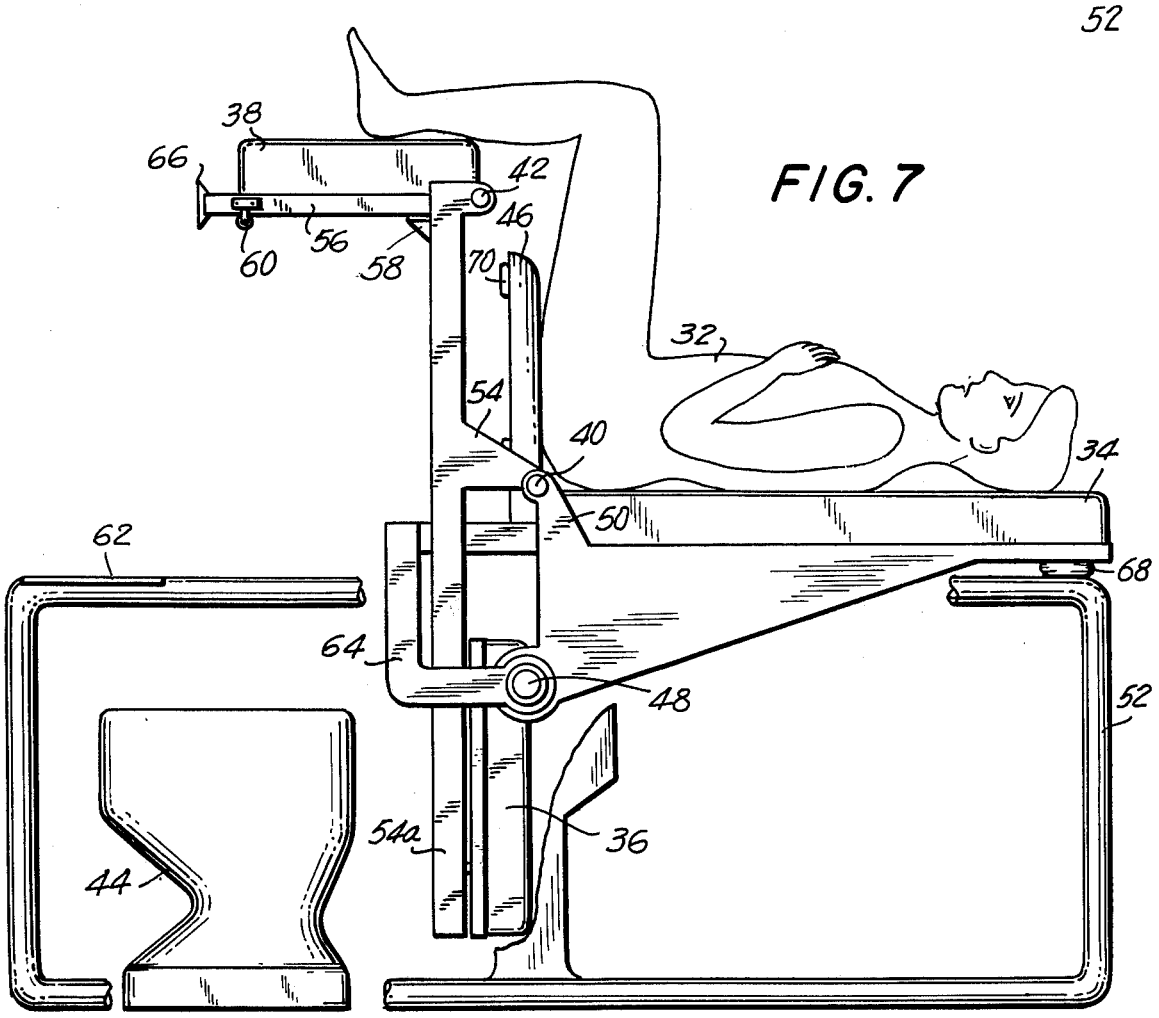
FIG. 7 is a side elevational view corresponding to the arrangement with the patient in the configuration of FIG. 2.
Figure 7A:
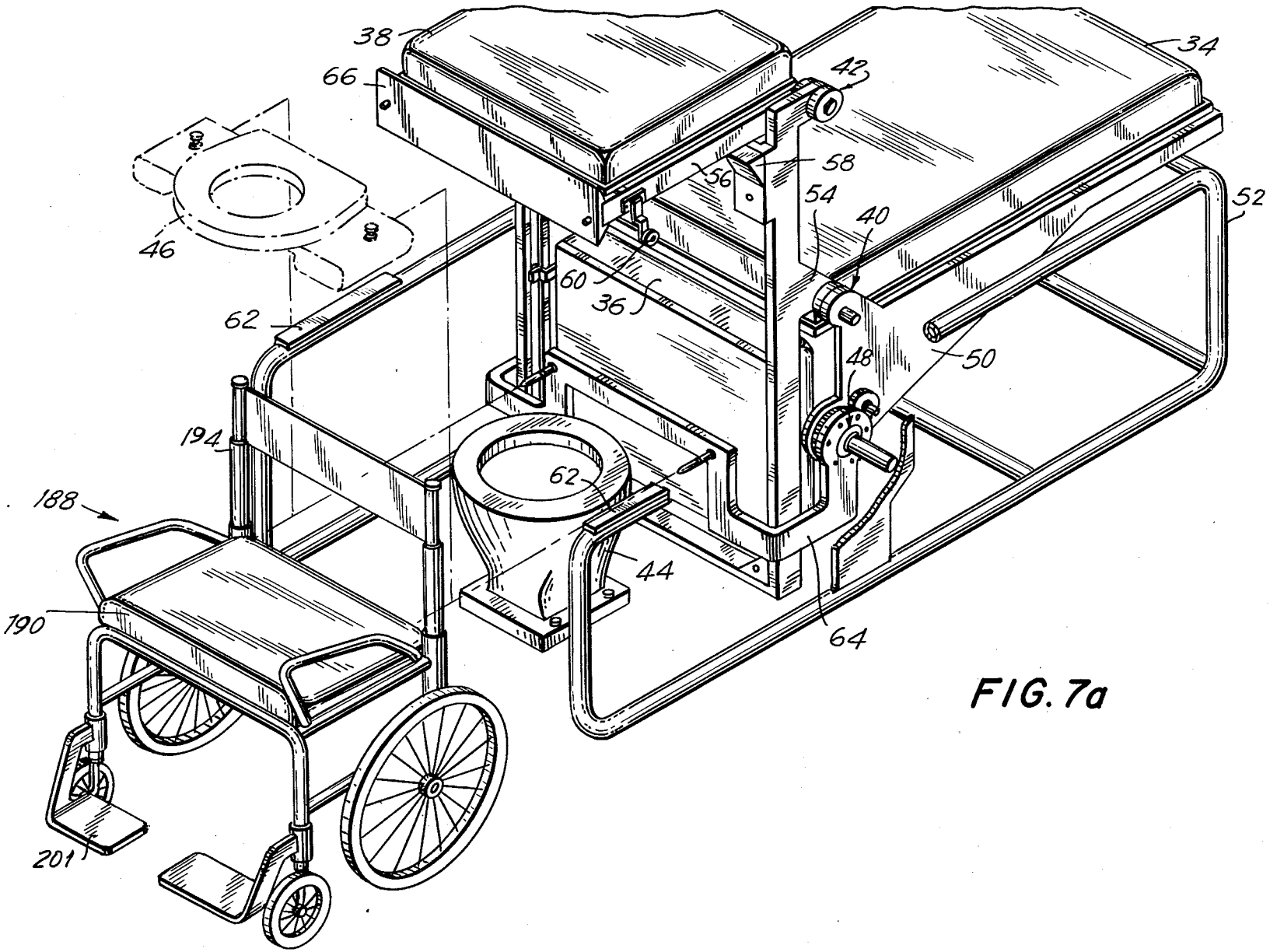
FIG. 7*a* is a perspective view of the arrangement when in the position of FIG. 7.

To enable the patient to use the toilet 44, frame member 54 is rotated relative to frame member 50 about the pivot 40, until the mattress section 36 is substantially at right angles to mattress section 34, as shown in FIG. 7. As frame member 54 is rotated from the position of FIG. 6 to the position of FIG. 7, frame member 56 rotates about the pivot 42, and assumes the position shown in FIG. 7, in which the mattress section 38 is substantially at right angles to the longitudinal axis of the frame member 54. Whereas power is required to rotate the frame member 54 relative to the frame member 50 about pivot 40, the frame member 56 becomes rotated to the position shown in FIG. 7 as a result of the action of gravity. The frame member 56 is held in the position of FIG. 7, in which mattress section 38 is horizontal, by a stop 58.

In the process of rotating frame member 54 about the pivot 40, to attain the configuration of FIG. 7, the frame member 56 becomes tipped as pivot 42 becomes raised from the level of the horizontal mattress section 34. During this tipping action of the frame member 56, the left end of the frame member 56 remains in contact with the main frame 52 by means of a roller 60 riding on a plate 62 secured to the main frame 52. This tipping action of the frame member 56 continues until the pivot 42 is raised sufficiently so that the frame member 56 abuts the stop 58. At that point in the process, the roller 60 ceases contact with the plate 62 and becomes raised upward until the position of FIG. 7 is attained. From the instant that the tipping action of frame member 56 begins, to the instant that the roller 60 leaves the plate 62, the roller 60 rides lengthwise along the plate 62. Once the frame member 56 comes against the stop 58, the plane of the frame member 56 supporting mattress section 38 is perpendicular to the plane of frame member 54 supporting mattress section 36.

The frame member 54 has a portion extending past the pivot 40 and in the downward direction when viewed in FIG. 7. This portion of the frame member 54, below the pivot 40, serves to hold the central mattress section 36 after the latter is lowered so as to uncover the posterior area of the patient. When the frame members 50, 54 and 56 are in the position of FIG. 6, this portion 54*a* of the frame member 54 extending past the pivot 40, lies within the frame member 50.

When the frame member 54 attains the position shown in FIG. 7 after being pivoted relative to frame member 50 about pivot 40, the central mattress section 36 is positioned at the top portion of the frame member 54, above the pivot 40. Thereafter, the mattress section 36 is lowered to the position shown in FIG. 7. The frame member 54 includes tracks cooperating with rollers on the mattress section 36 to enable the latter to ride along the frame member 54 from the top position to the lower-most position shown in FIG. 7. The track and roller combination associated with the central mattress section 36 will be described subsequently.

After the central mattress section 36 has been lowered to the extent that it becomes held by the portion 54*a* of the frame member 54, the toilet seat 46 is rotated and raised upwards until it contacts the posterior of the patient, as shown in FIG. 7. To achieve this motion of the toilet seat 46, the latter is connected to a link 64 rotatable about the pivot 48. In moving the toilet seat 46 from above the toilet bowl 44 and into contact with the patient's posterior, the toilet seat is rotated through an angle of substantially 90°. The motion of the toilet seat from the position shown in FIG. 6 to the position shown in FIG. 7, is accomplished through a single rotational step about the pivot 48. For this purpose, the center of the pivot 48 lies at the intersection of the plane of the toilet seat when positioned on the bowl 44 and the plane of the seat when in the position of FIG. 7, in which the seat contacts the patient's posterior.

Figures 8, 10:
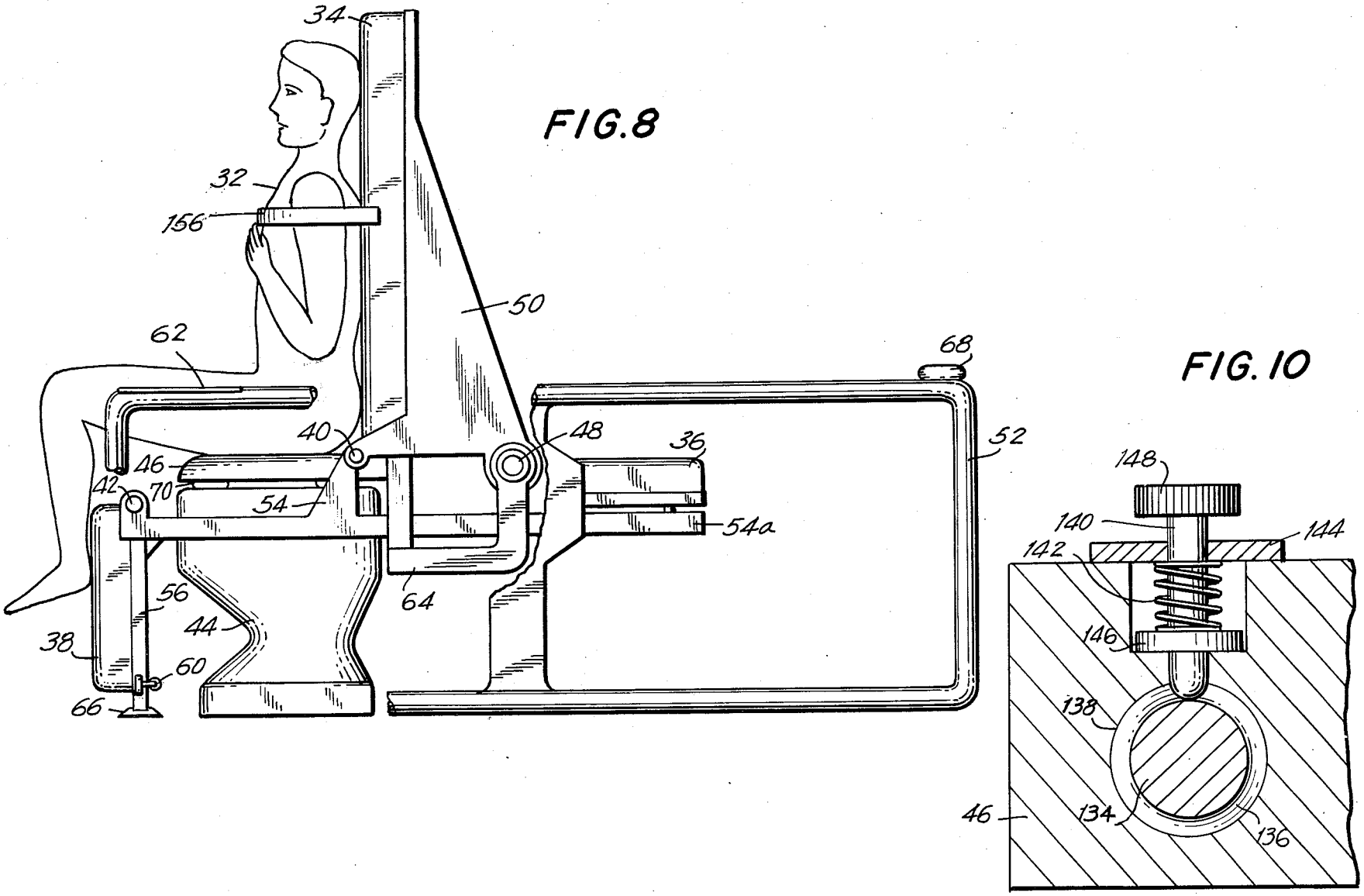
FIG. 8 is a side elevational view and shows the position of the patient when in upright seated position corresponding to the schematic configuration of FIG. 5.
FIG. 10 is a sectional view taken along line 10—10 in FIG. 9.
Figure 8A:
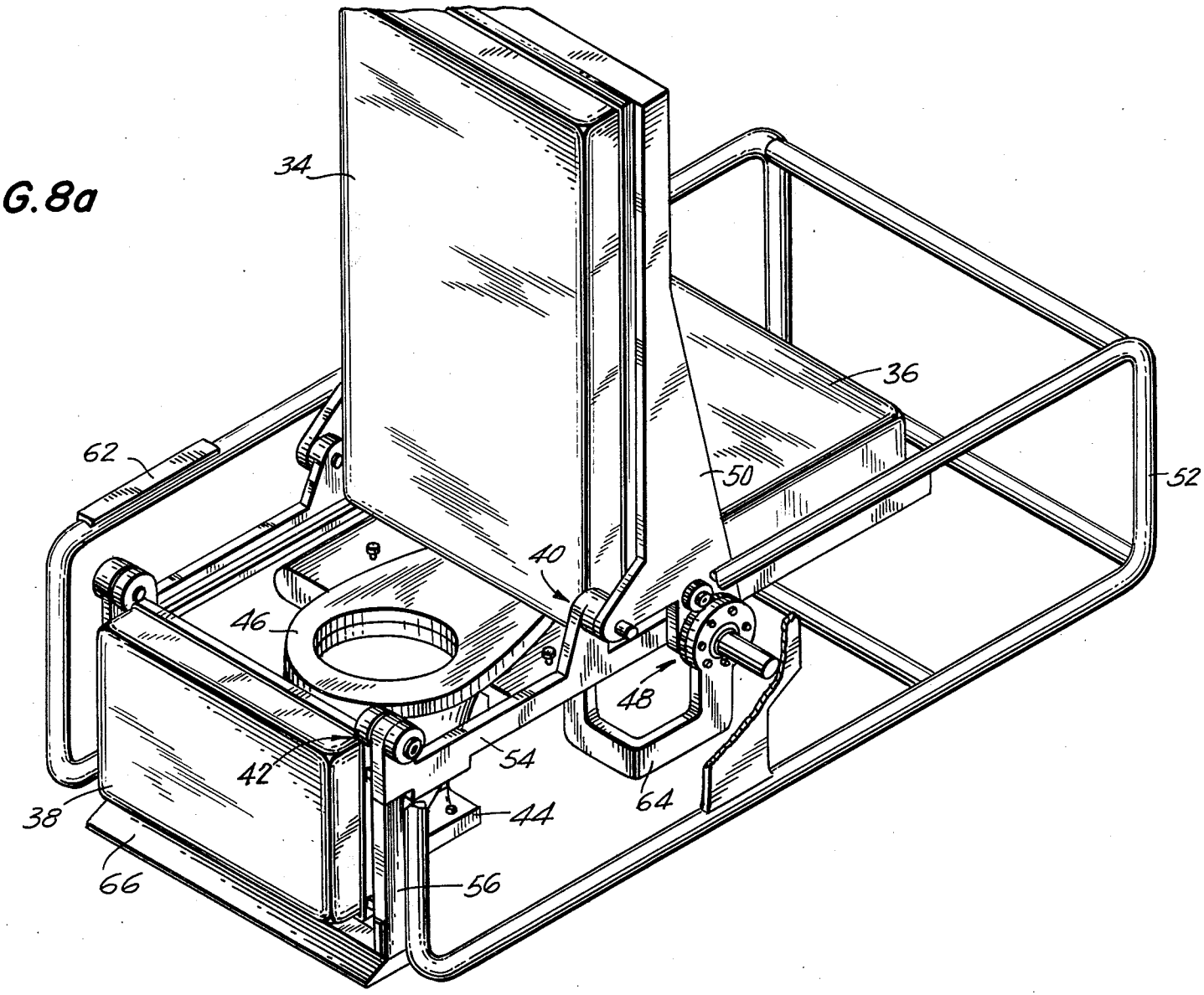
FIG. 8*a* is a perspective view and shows the arrangement of the present invention when in the position of FIG. 8.

After frame members 50, 54 and 56 have attained the relative positions shown in FIG. 7, they remain locked in these relative positions, prior to positioning the patient over the toilet bowl. For purposes of moving the patient onto the toilet bowl with the seat 46 in place, the entire configuration of FIG. 7 is rotated about the pivot 48 to the position shown in FIG. 8. Thus, prior to rotating the assembly of FIG. 7 about pivot 48, the central mattress section 36 is in place on the portion 54*a* of the frame member 54, while the seat 46 is in contact with the patient's posterior. After rotation about the pivot 48, the toilet seat 46 is positioned back over the bowl 44, as shown in FIG. 8. At the same time, the mattress section 36 attains a horizontal position, as a result of the rotation about pivot 48 to the position shown in FIG. 8.

When in the position of FIG. 8, furthermore, the mattress section 38 hangs downward beneath the top of the bowl 44, and is in contact with the calf of the leg of the patient. The frame member 56 abuts the ground or floor surface by means of the stop 66 at the end of the frame member 56. Accordingly, the rotation of the assembly of FIG. 7, in locked position, is carried out through an angle in which the stop 66 contacts a surface of the floor or ground. At that point, the seat 46 is in contact with the top of the bowl 44.

After the patient has completed use of the toilet and is prepared to be returned to a reclined position, the assembly of FIG. 8, in locked position, is rotated back about pivot 48, to the position shown in FIG. 7. Thereafter, the toilet seat 46 is returned to the position over the bowl 44 by being rotated about the pivot 48 by means of link 64, and the mattress section 36 is raised upwards so as to return to its position where it is in contact with the patient's posterior. Frame member 54 is then rotated relative to frame member 50 about pivot 40 until rollers 60 contact plates 62 and ride along these plates 62 to the position shown in FIG. 6.

Bumpers 68 may be provided between mattress section 34 and main frame 52 for the purpose of absorbing any shock which may result when mattress section 34 is returned back to its horizontal position onto the main frame 52. Similarly, bumpers 70 may be provided beneath the toilet seat 46 to absorb any shock resulting when the seat is placed onto the bowl 44.

Figure 9:
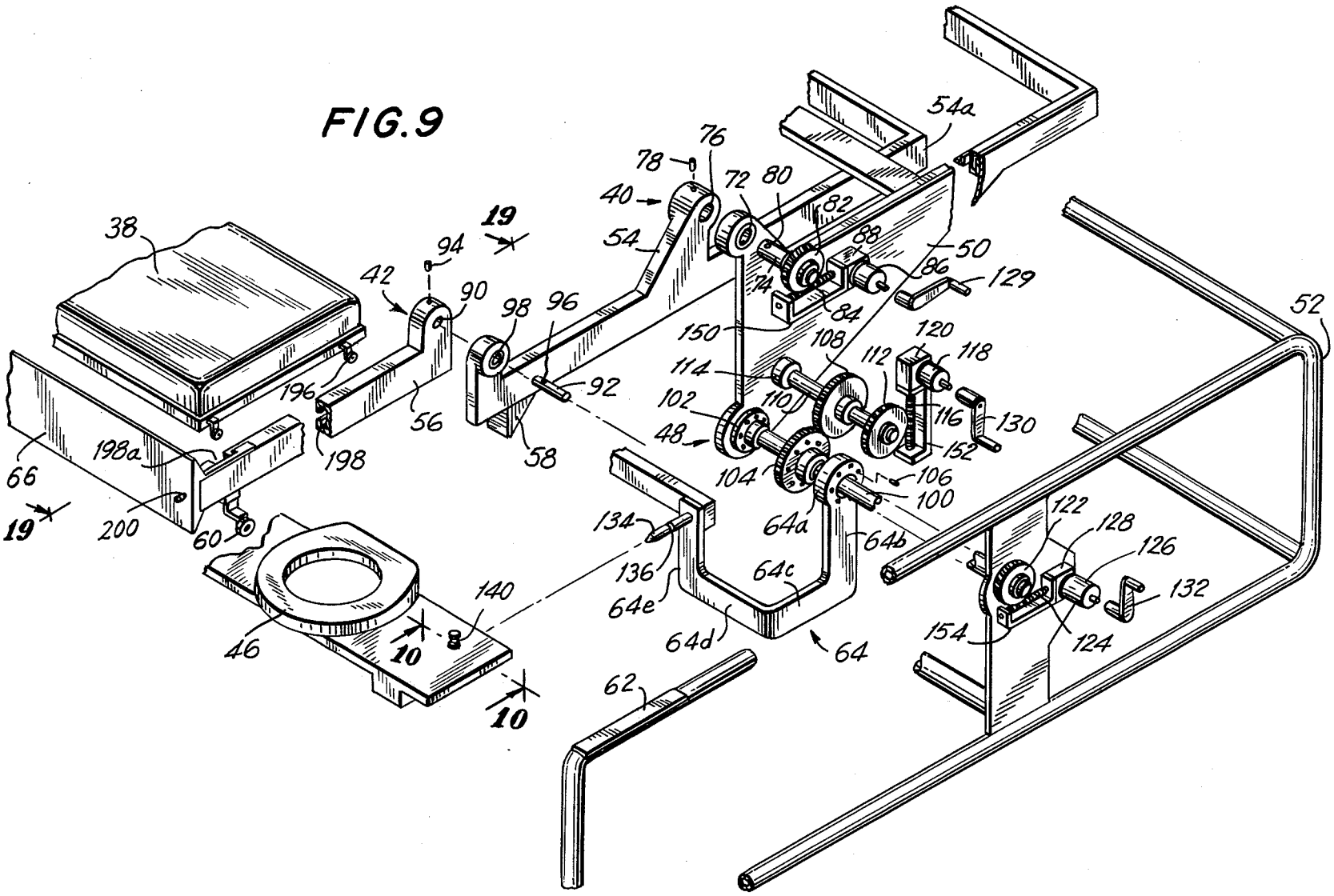
FIG. 9 is a perspective exploded view and shows the interrelationship of the essential moveable elements, in accordance with the present invention.

The construction of the pivots 40, 42 and 48, as well as the power transmission linkage used to move the associated frame members may be seen in the partial exploded view of FIG. 9. The frame member 50 is shown in FIG. 9, to have a bore 72 through which a shaft 74 is inserted. This shaft 74 extends also into a bore 76 in the frame member 54. This frame member 54 is locked to the shaft 74 by means of a key or locking pin 78, for example, which passes through the hub portion containing the bore 76 and becomes inserted into a drilled hole 80 in the shaft 74. Accordingly, the frame member 54 rotates with the shaft 74. At the same time, the shaft 74 rotates freely within the bore 72.

Mounted onto the shaft 74, furthermore, is a worm gear 82. This worm gear 82 is fastened to the shaft 74 and rotates therewith. The worm gear 82 is driven by a mating threaded worm 84 linked to a driving motor 86 through a conventional geared connection unit 88. With such construction of the pivot 40, therefore, operation of the driving motor 86 causes the frame member 54 to rotate relative to the frame member 50 by means of the linkage including elements 72–88. By using the threaded worm 84 in combination with the worm gear 82, furthermore, the pivot 40 has a self-locking feature, since the frame member 54 is automatically locked in position relative to frame member 50 for any angular position of the gear 82, as a result of the condition that gear 82 cannot drive reversibly the worm 84.

In the construction of pivot 42, the frame member 56 has a bore 90 for the insertion of a shaft 92. The shaft 92 is fixed or keyed to the frame member 56, by means of a locking pin 94 which passes through the hub portion about the bore 90, and penetrates the shaft 92 through a drilled hole 96 therein. The shaft 92 also passes through a bore 98 in the frame member 54. The frame member 56 is keyed to shaft 92 and is freely rotatable in bore 98. Accordingly, when frame member 54 is rotated about pivot 40 by means of the motor 86, for example, the weight of the frame member 56 with the mattress section 38 thereon, serves to rotate relative to the frame member 54, as a result of the action of gravity. Consequently, no external driving source is required to rotate the frame member 56 relative to the frame member 54.

In the construction of the pivot 48, it is required that the link 64 be rotatable about the center of this pivot, independent of the frame member 50. To achieve this result, a shaft 100 is attached to the frame member 50 by means of a flange member 102. Accordingly, the frame member 50 rotates fixedly with the shaft 100. Mounted on the shaft 100, furthermore, is a spur gear 104. The spur gear 104 is freely rotatable about the shaft 100, and is fastened to the link 64 by means of bolts 106 distributed about the face of the gear 104. Thus, the bolts 106 fasten a hub portion 64*a* of the link 64 to the gear 104. The gear 104, furthermore, is in mesh with a spur gear 108 fixed to a shaft 110. Also fixed to the shaft 110, is a worm gear 112. The shaft 110 is freely rotatable with respect to the frame member 50, in a bearing 114 attached to the frame member 50. The shaft 110 is rotated with spur gear 108 by driving the worm gear 112 with a threaded worm 116. The latter is driven, in turn, by means of a motor 118 through a conventional geared connection unit 120. Consequently, by operating the motor 118, the spur gear 104 in mesh with gear 108 becomes rotated, and link 64 becomes thereby rotated correspondingly. Since spur gear 104 rotates freely about the shaft 100 which is fixed to the frame member 50 by means of the flange 102, the link 64 may be rotated by means of the motor 118, independent of the rotation of the frame member 50.

To rotate the frame member 50 for the purpose of achieving the position of this member as shown in FIG. 8, the shaft 100 attached to the frame member 50, is rotated by means of a further worm gear 122 fixed to the shaft 100. The worm gear 122 is in mesh with a threaded worm 124 driven by a motor 126 through a conventional geared connection unit 128. Therefore, by operating the motor 126, the shaft 100 and hence frame member 50 becomes rotated independent of the position of the link 64. By providing a worm gear in combination with a threaded worm for driving the frame member 50, a self-locking feature is also obtained with regard to the positioning of this frame member 50, since the worm gear 122 cannot reversibly drive the threaded worm 124. As a result, the weight of the patient acting against the frame member 50 cannot cause this frame member to move unexpectedly downward from the weight of this member as well as the patient. Consequently, the worm gears in combination with their respective threaded worms used in the pivots 40 and 48, function as safety devices as well as power transmission means. The combination of worm gear and threaded worm, furthermore, provide a compact and simple device for large speed reduction of the motor output shafts. Attached to frame member 50 are the stationary supports 150 and 152 for the threaded worms 84 and 116 respectively, together with associated motors and connecting units.

Whereas the motors 86, 118, and 126 may be used as a convenient source of power for operating the arrangement, in accordance with the present invention, it is also possible to carry out the operation manually by means of cranks, 129, 130, and 132 which may be applied directly to the shafts projecting from the housings of motors 86, 118, and 126, respectively. Thus, in the event that power failure or power is otherwise unavailable, and there is a need for operating the arrangement of the present invention for the comfort of the patient, these manually operated cranks 129, 130, and 132 may be applied directly onto the shafts of the respective motors. For this purpose, the shaft of the motors project from the back sides thereof. When the motors are operated, on the other hand, the hand cranks are disengaged from the motor shafts or are entirely removed therefrom.

To permit the toilet seat 46 to be moved from the position on the toilet bowl 44 to the position where the seat is in contact with the patient's posterior while the frame member 54 has been turned as shown in FIG. 7, the link 64 has the construction shown in FIG. 9. Extending from the hub protion 64*a*, is a downward directed portion 64*b* to which is joined a horizontal portion 64*c*. A further horizontal portion 64*d* adjoins the portion 64*c* at right angles thereto. The link 64 terminates in an upward directed portion 64*e* which adjoins the portion 64*d*. This particular shape of the link 64 provides for the clearances required for operating the link through its path of movement without interference with other parts, while assuring that the toilet seat 46 is lifted from the bowl and placed supportingly against the posterior of the patient.

To connect the toilet seat 46 to the link 64, connecting pins 134 with peripheral grooves 136 are provided on the link 64. The pin 134 is inserted into an opening 138 of the toilet seat, as shown in FIG. 10. The groove 136 passes underneath a latching pin 140 which is actuated by a spring 142 bearing against a cover 144 and a shoulder 146 of the pin 140. The spring 142 serves to retain the bottom portion of the pin within the groove 136, so as to prevent the toilet seat 46 from slipping off the connecting pin or shaft 134. To remove the toilet seat from the connecting pin 134, the head 148 of the pin 140 is raised against the applied force of the spring, so that the bottom portion of the pin 140 is removed from the groove 136.

The main frame 52 may be of tubular construction for purposes of economical design. Attached to the main frame 52 is the stationary support 154 for the threaded worm, 124, respectively, and the associated motor and geared connecting unit.

Figure 11:
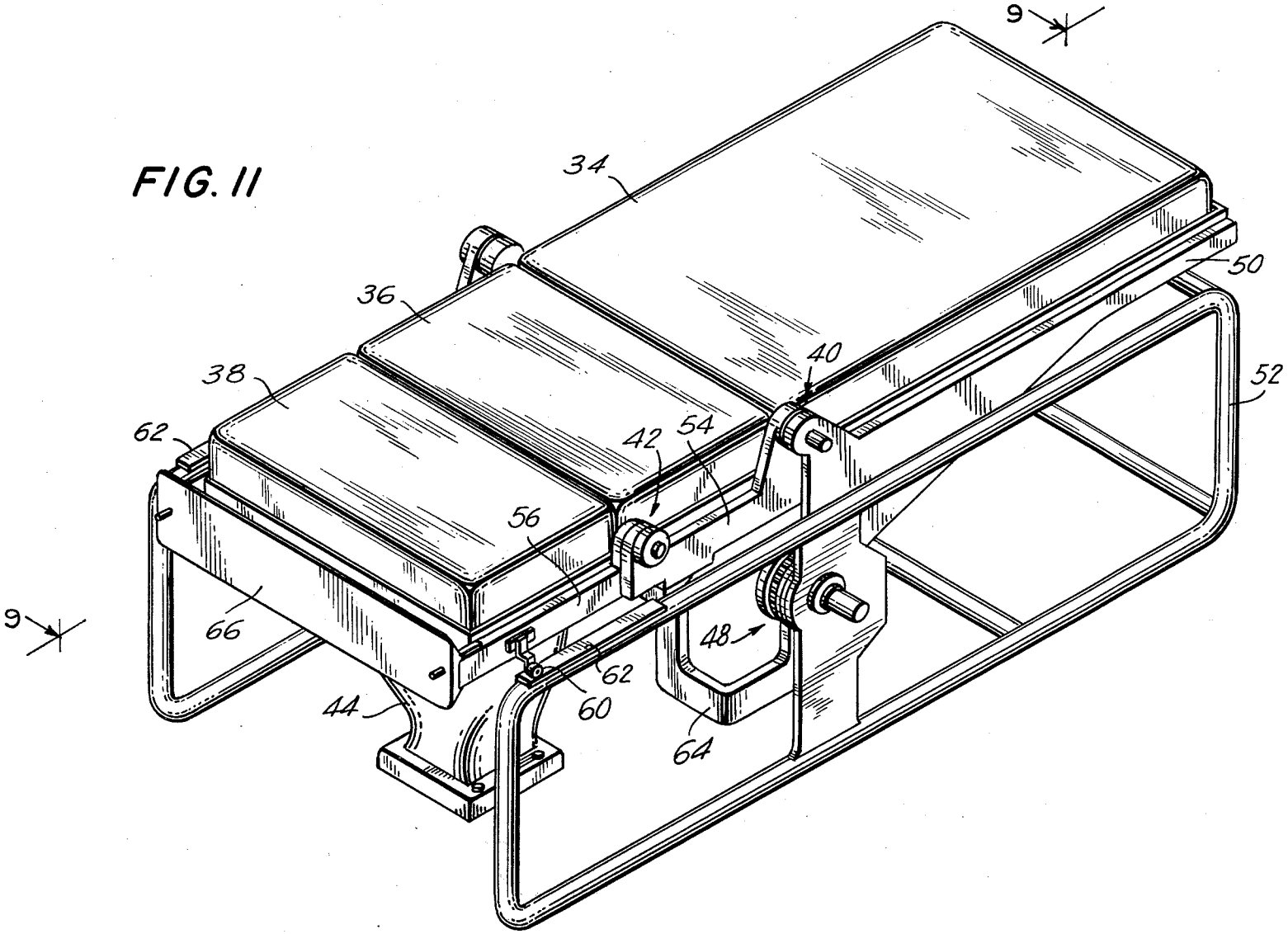
FIG. 11 is a perspective view and shows the top and side views of the arrangement when in a position corresponding to FIG. 6.

For purposes of clarity, the construction of the frame members 50, 54 and 56 together with the operating mechanisms therefore, are shown only for one side of the patient's bed, since the view of FIG. 9 is taken along 9—9 in FIG. 11. In particular, the view of FIG. 9 discloses the construction on the near side of the bed when viewed in FIG. 11. The far side of the bed has a duplicate of the construction of FIG. 9, with the exception that the power driving sources 86, 118, 126 with their respective linkages are omitted.

If the patient lacks the muscle control for sitting upright, then a strap 156 may be applied, as shown in FIG. 8, to hold the person upright and against mattress section 34.

Figure 12:
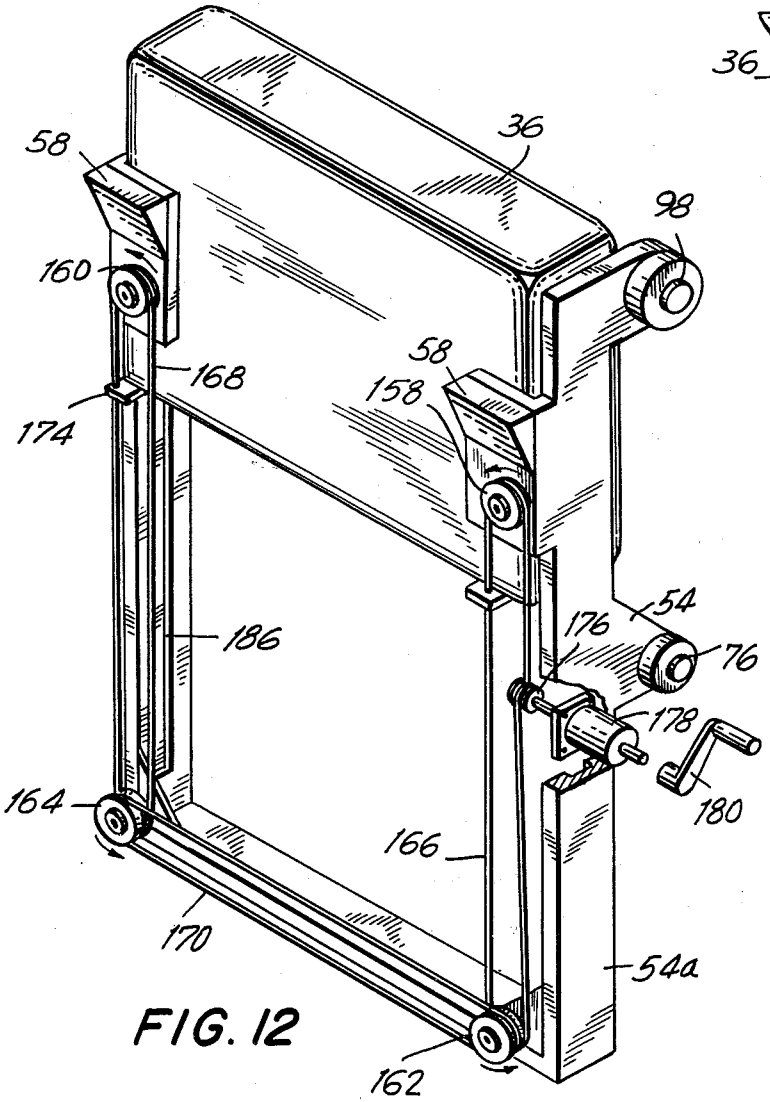
FIG. 12 is a perspective view and shows the construction for removing a mattress section in contact with the posterior of the patient prior to use of a toilet or seating into a wheelchair.

For the purpose of lowering the central mattress section 36 to attain the configuration of FIG. 7, frame member 54 is constructed further in accordance with the arrangement of FIG. 12. The frame member 54 includes mountings for single belt pulleys 158 and 160. These pulleys have grooves for accommodating, for example, a V-belt. Additional double pulleys 162 and 164 also mounted on the frame member 54, are linked to pulleys 158 and 160 by means of V-belts 166 and 168, respectively. Pulleys 162 and 164 are linked, furthermore, with a similar type of belt 170. Belts 166 and 168 are fastened or clamped, respectively, to clamping elements 172 and 174 fixed to the mattress section 36.

When pulley 169 is rotated in the direction shown by the arrow in FIG. 12, in counter clockwise direction, the clamping element 174 becomes lowered as a result of being clamped to the belt 168. At the same time, the movement of the endless belt 168 causes the rotation of the pulley 164, and hence the movement of belt 170 linked to the pulley 162. Pulley 162 executes, thereby, also counter clockwise rotation. Belt 166 links pulley 162 with pulley 158 through a capstan 176 so that pulley 158 also rotates in counter clockwise direction, or the same direction as pulley 160.

The capstan 176 is provided as a source for driving the belt 166, and hence the remaining belts and pulleys for the purpose of lowering and raising the mattress section 36. The capstan is connected to a driving motor 178 mounted on the frame member 54. The capstan 176 functions in the conventional manner in which the belt 166 is looped around the capstan by a single revolution or a whole number of revolutions, for example. By means of the hand crank 180, the belt 166 may be operated manually in a manner similar to that described with respect to the hand cranks 129, 130, 132 shown in FIG. 9.

Figure 14:
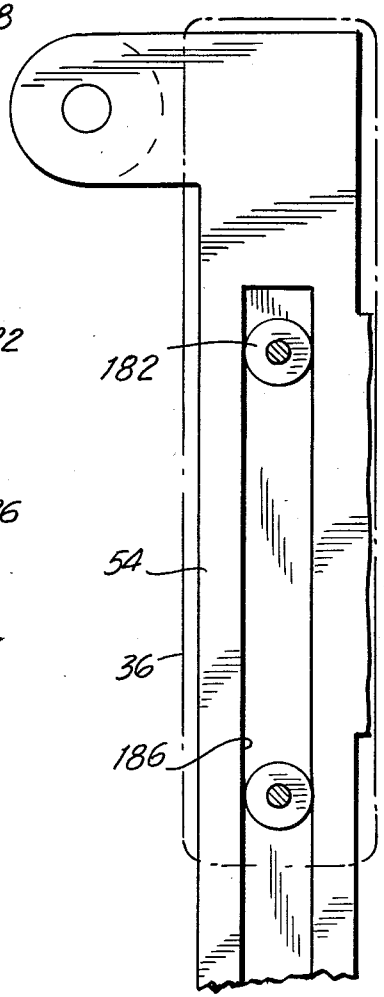
FIG. 14 is an end view taken along line 14—14 in FIG. 13.
Figure 13:
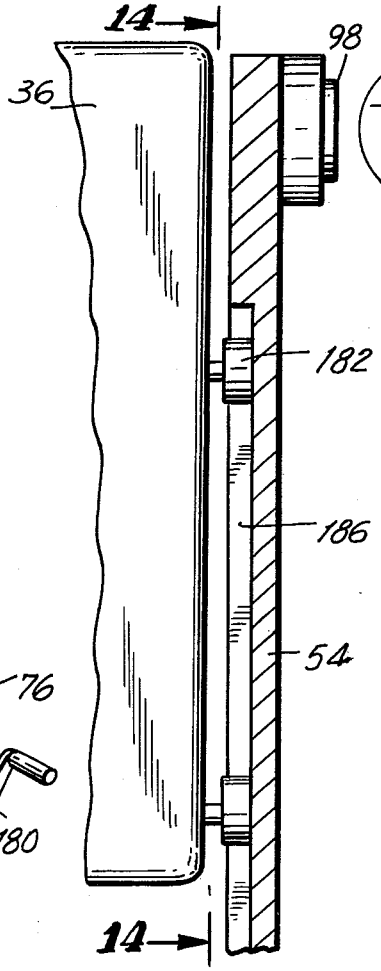
FIG. 13 is a side view and shows the construction for holding the moveable mattress section in the combination shown in FIG. 12.

In moving the central mattress section 36 along the frame member 54, for purposes of lowering and raising this mattress section, the latter is provided at the side with freely rotating rollers 182 as shown in FIGS. 13 and 14. These rollers 182 are freely rotatable on shafts 184, for example, fixed to the mattress section 36. The rollers ride within a track 186 provided in the frame member 54. Accordingly, the tracks 186 on each side of the frame member 54 provide means for guiding the mattress section 36 while being raised and lowered.

In accordance with the present invention, it is also possible to fixedly attach an auxiliary toilet seat which becomes exposed when the mattress section 36 is lowered. The patient comes thereafter in contact with this auxiliary seat when the frame member 54 becomes rotated about pivot 48 to bring the patient into the position shown in FIG. 8. In this arrangement, the weight of the patient serves to bring the patient's posterior in contact with the auxiliary toilet seat. Such an auxiliary toilet seat is then positioned either directly on top of the bowl 44, or on the seat 46 which remains in place thereon, and is not brought up toward the patient as shown in FIG. 7. After the patient has completed the use of the toilet, and is returned to the position shown in FIG. 7 by rotation about pivot 48, the weight of the patient is no longer directed against the plane of the toilet seat. The mattress section 36 can then be pushed upwards to reposition it underneath the patient's posterior. Whereas this arrangement may require a substantial amount of force to push the mattress section 36 back upwards against the patient, after completion of the use of the toilet, such an arrangement avoids the requirement of the link 64. In this embodiment, the auxiliary toilet seat serves as the means of support for the posterior of the patient during the transition from the position in FIG. 7 to FIG. 8.

Figure 15:
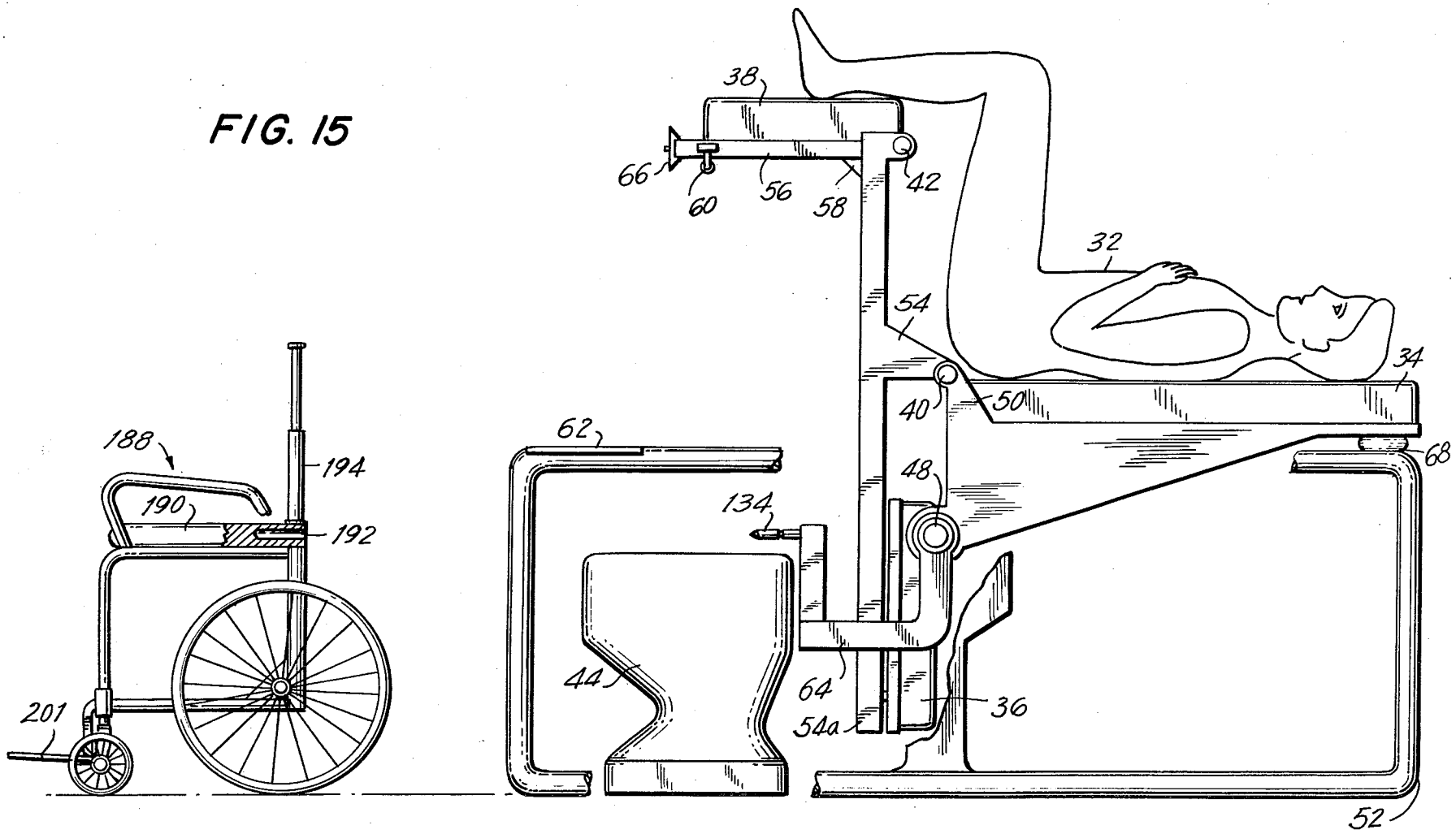
FIG. 15 is a side elevational view and shows the arrangement of the present invention preparatory to placing the patient into a wheelchair.

In a further embodiment of the present invention, as shown in FIG. 15, the toilet seat 46 is removed from the connecting pins or shafts 134 by pulling upward the heads 148 of the latch pins 140 to withdraw the bottom of the pins from the grooves 136 of the connecting shaft 134. A wheelchair 188, shown in FIG. 15, is then rolled over the toilet 44 and brought into contact with the connecting shafts 134. The wheelchair 188 has a seat 190 provided with openings 192 which are substantially at the same height level as the shafts 134 on line 64. Thus, the spacing and dimensions of the openings 192 correspond to those of the openings 138 of the toilet seat 46, so that the seat 190 of the wheelchair may be connected directly onto the guide or connecting shafts 134 attached to the link 64. The width of the wheelchair 188 is provided sufficiently large to straddle or pass over the toilet bowl 44.

To place the patient into the wheelchair 188, in accordance with the present invention, frame member 54 is rotated with respect to frame member 50, in a manner described above, so as to attain the position of these frame members and the patient, as shown in FIG. 15. The toilet seat 46 is then removed from the link 64, as already described, and the wheelchair is rolled or wheeled over the toilet bowl 44 for purposes of connecting the seat 190 to the connecting shafts 134. The wheelchair has a retractable or removable backrest 194. This backrest 194 is removed prior to connecting the wheelchair to the link 64 by means of the connecting shafts 134. Wheelchairs with retractable or removable backrests are already known in the art, and for this reason this construction is not described further in detail here. The connection of the wheelchair to the link 64, with the backrest retracted or removed, is shown in FIG. 16.

Figure 16:
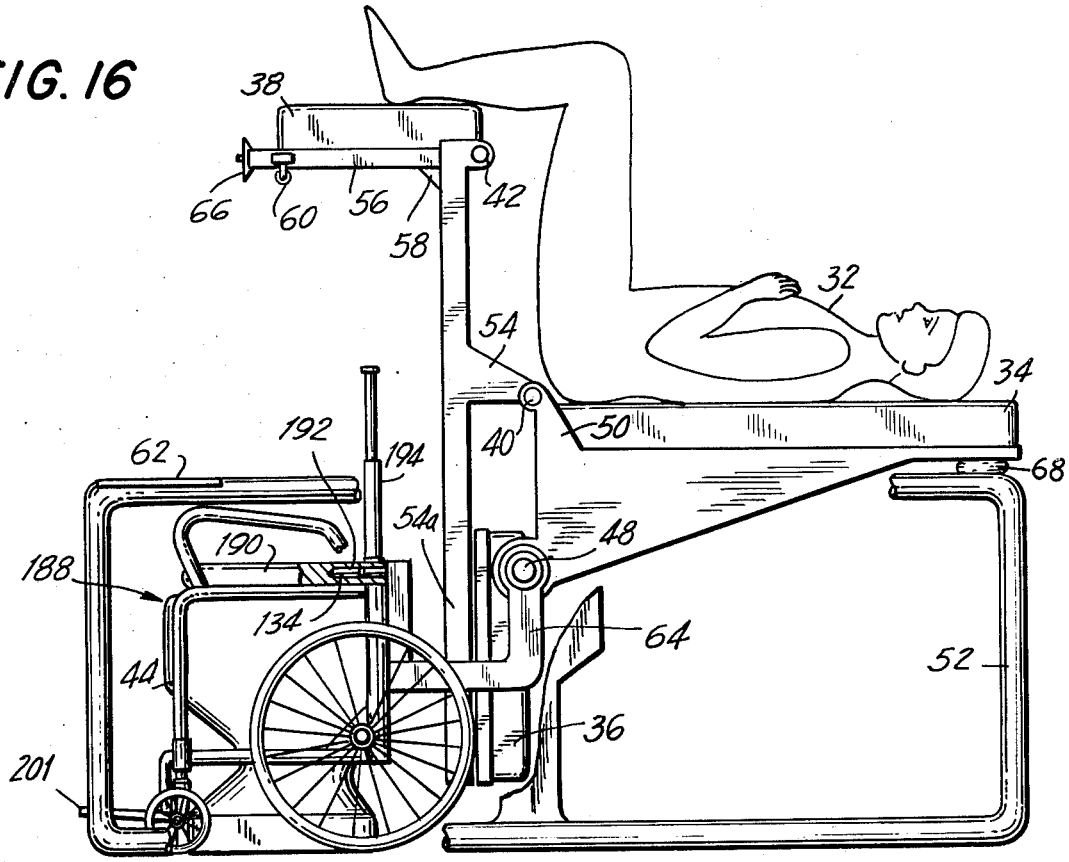
FIG. 16 is a side elevational view and shows the arrangement of FIG. 15 with the wheelchair in connected position.
Figure 17:
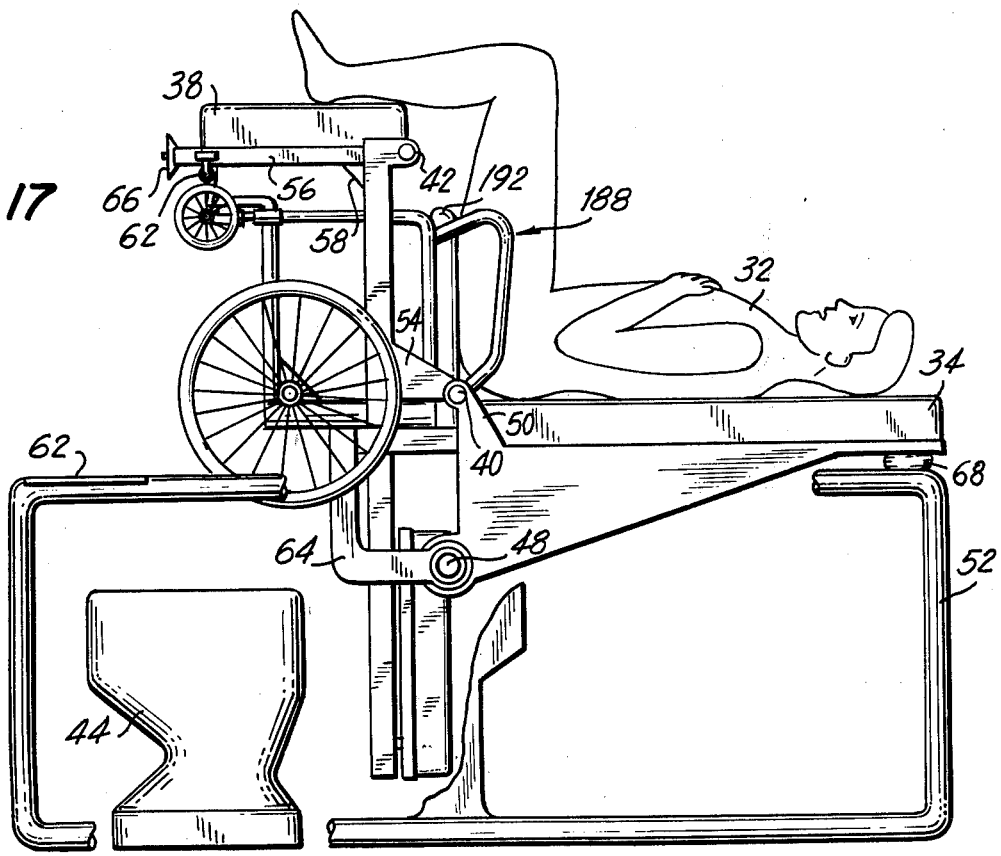
FIG. 17 is a side elevational view and shows the arrangement of FIG. 15 with the wheelchair moved into contact with the posterior of the patient.

After the wheelchair has been connected in the manner shown in FIG. 16, the link 64 is rotated to bring the wheelchair into the position in which the chair seat 190 is in contact with the posterior of the patient, as shown in FIG. 17. In order to bring the seat 190 in contact with the patient, it is essential to have lowered previously the central mattress section 36 in the manner already described.

Figure 18:
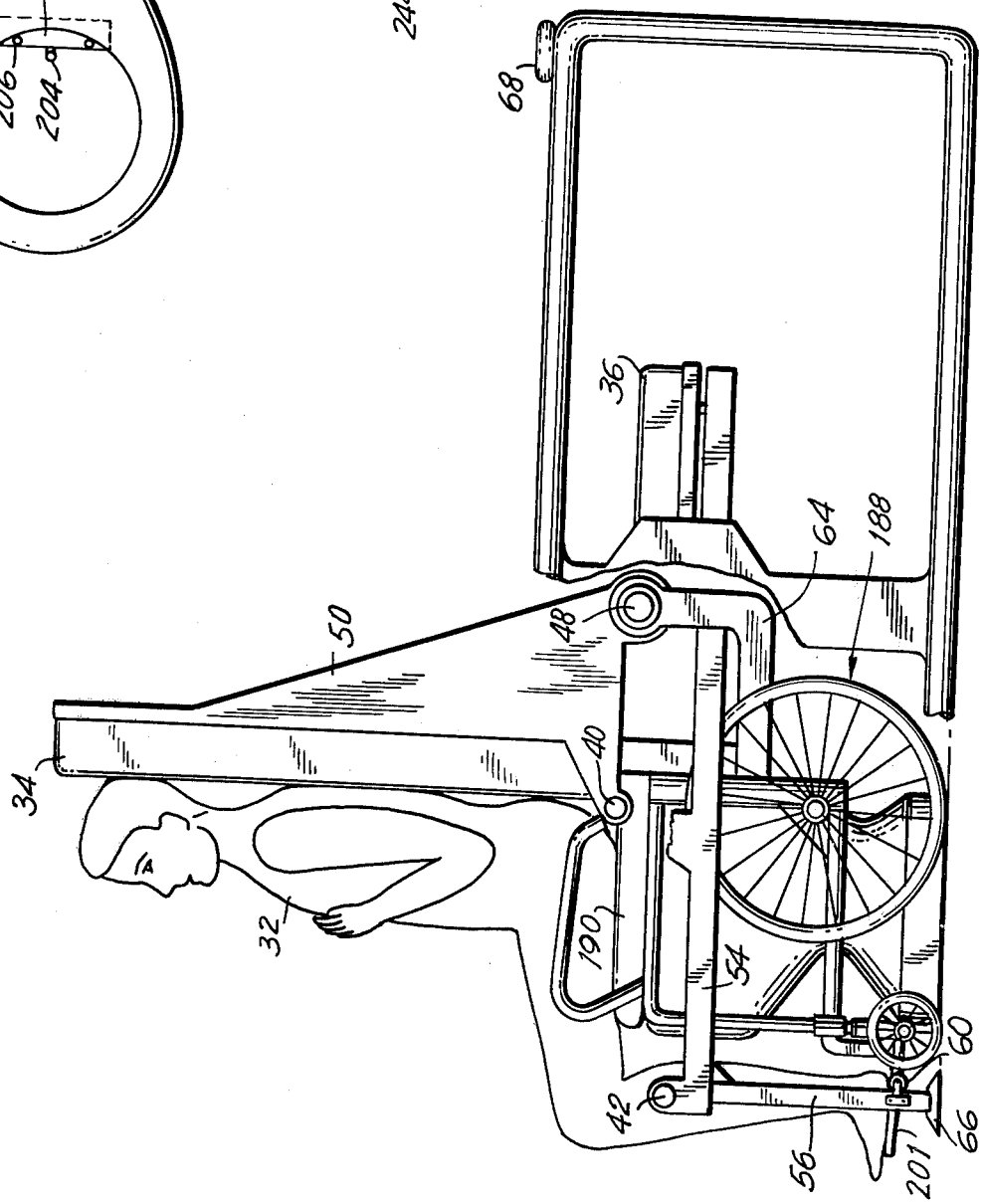
FIG. 18 is a side elevational view and shows the patient after having been placed into a wheelchair in accordance with the present invention.
Figure 19:
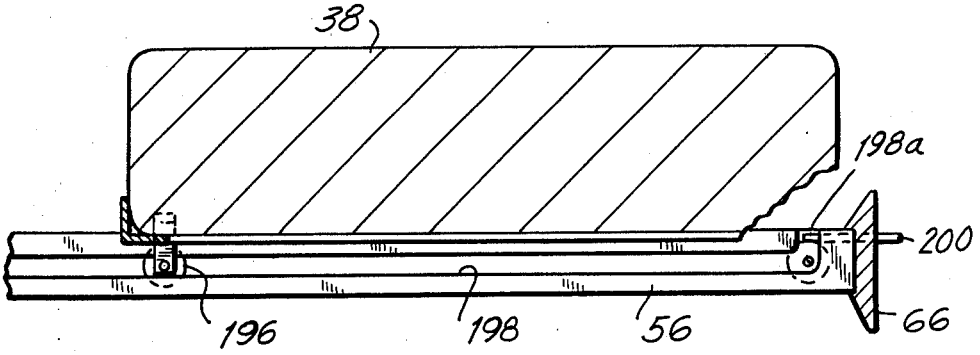
FIG. 19 is a sectional view taken along line 19—19 in FIG. 9.

After attaining the configuration of FIG. 17, the assembly of the wheelchair, line 64 and frame members 50, 54, 56 is rotated about pivot 48 to the position shown in FIG. 18. In this configuration of FIG. 18, the patient sits upright in the wheelchair.

Figure 20:
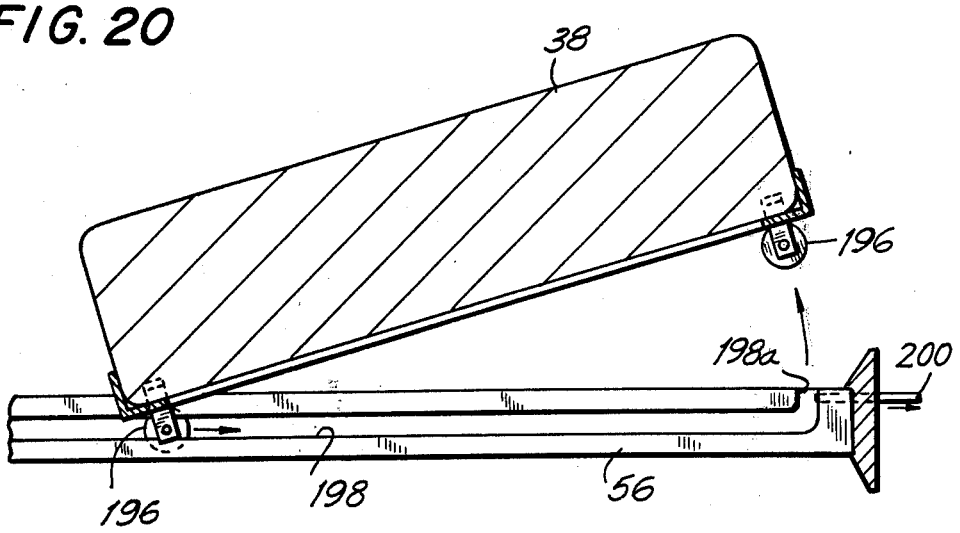
FIG. 20 is a sectional view of the construction of FIG. 19 and shows the method of removing a mattress section in contact with the lower part of the legs of the patient after placement in a wheelchair.

To move the wheelchair freely away from the connecting link 64 and mattress section 34, mattress section 38 is removed from its frame 56. To facilitate simple removal of the mattress section 38, the latter is provided with rollers 196 which ride in tracks or grooves 198 in the frame member 56. The groove 198 has an opening 198a leading to the exterior. The rollers or wheels 196 can ride along the track 198 and then pass out of the track or groove 198 through the opening 198a, after withdrawal of the pin 200. To remove the mattress section 38 from the frame 56, the wheels 196 which are closest to the opening 198 are passed through this opening and the mattress section 38 is tipped away from the frame 56 with the remaining wheels 196 at a distance from the opening 198a still remaining in the groove 198. The remaining wheels at the back end of the frame 56 then ride along the grooves 198, after removal of the front wheels and tipping of the section 38, as shown in FIG. 20. After passing the back wheels also through the opening 198a, the mattress section 38 has been removed. The pin 200 prevents the front wheels 196 from slipping out of the groove 198 inadvertently. Thus, the pin 200 is withdrawn only during the period of time that the mattress section 38 is to be removed to allow the wheelchair to become disconnected from the link 64.

After removal of the foot mattress section 38, the wheelchair may be disconnected from link 64 by raising the latching pin 140, and rolling the wheelchair from over the toilet bowl 44. Thereafter, the backrest 194 may be raised or inserted. To facilitate passage of the wheelchair over the bowl 44, the foot rests 201 of the wheelchair may be folded out of the way, so as not to interfere with the passage of the wheelchair against the link 64. The folding of the foot rests of wheelchairs for this purpose, is well known in the art and is, therefore, not described further in detail here.

To return the patient from the wheelchair onto the mattress 30, the procedures of FIGS. 15 to 20 are carried out in reverse, in sequence of FIGS. 18, 20, 19, 17, 16, and FIG. 15.

It is an important feature of the present invention that the mattress 30 with its free sections 34, 36, and 38 can be maintained clean economically. Thus, the central section 36 which is particularly susceptible to becoming soiled, may be readily replaced, without having to replace other sections of the mattress. Accordingly, the section 36 may be replaced beneath the patient and transported away for cleaning and maintenance services. It then can be reused for the same bed or another bed after it has been properly restored. The cleaning and servicing of a substantially small section such as 36, for example, is considerably more economical than cleaning and servicing an entire mattress.

Figure 21:
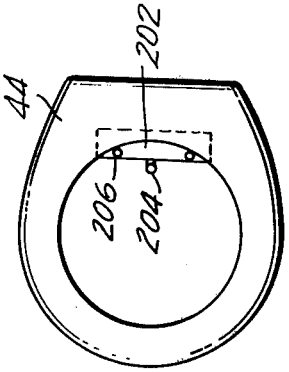
FIG. 21 is a plan view of a toilet provided with cleansing means, in accordance with the present invention.
Figure 23:
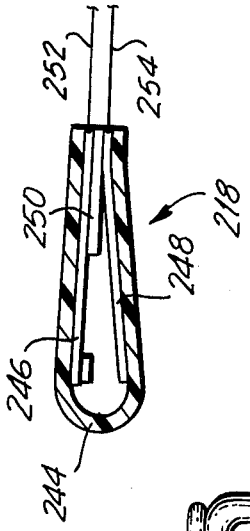
FIG. 23 is a sectional view and shows an actuating element operable by the patient for actuating the controlling circuit of FIG. 22.

Hygienic cleansing of the patient after usage of the toilet, may be achieved by means of a cleansing device 202 mounted directly within the toilet bowl 44, as shown in FIG. 21. The device 202 is of conventional construction and may be electrically operated to apply a spray of water against the patient's posterior when desired. The water spray is under pressure and will, thereby, perform the required cleansing operation. This water spray emerges from the device 202 through, for example, a nozzle 204 thereon. The wetted surface of the patient can be dried by releasing, after the water spray, a stream of heated air through openings 206, for example. Both the water spray and the drying air can be heated to a desired temperature so as to be comfortable when applied to the patient. Furthermore, both the water spray and the drying air can be applied, when desired, by actuating an electrical switch or applying a suitable electrical signal to the device 202. Since the device 202, sometimes referred to in the trade as a bidet, is commercially available and well known in the art, the device is not described in further detail here. The device 202 is installed at the rear of the opening of the toilet bowl 44, for example, and serves only as a source of water spray and drying air directed against the patient's posterior.

The operation of the several motors as well as the cleansing device 202 used in the arrangement, in accordance with the present invention, may be achieved by actuating individual switches connected to the motors, in the conventional manner. At the same time, an automatic sequence of the various cycles and stages of operation of the arrangement, of the present invention, may be obtained by means of the control circuit shown in FIG. 22. In this circuit, a counter 208 serves to provide a series of signals applied to the several motors and the cleansing device 202, in proper sequence so as to carry out a complete cycle which allows the patient to use the toilet or become seated in a wheelchair.

Accordingly, the counter 208 is a six-stage counter which applies driving signals to motors 86, 118, 126, and 178. Driving signals are also provided for the cleansing device 202 for applying cleansing water and drying air. In the initial stage or setting of the counter 208, a signal is applied to the input 210 of an AND gate 212. The other input 214 of this gate 212 is connected to the output of a flip-flop or bistable switching circuit 216. In this initial stage of the counter 208, no signal is applied to the gate input 214 when the arrangement of the present invention is not to be operated. When, on the other hand, the arrangement is to be operated, a switch 218 is actuated to apply a pulse, for example, to the bistable circuit 216. As a result, gate 212 applies a signal to the motor 86, since both inputs of the gate are now applied. The motor 86 commences thereby to operate and rotate the frame member 54 relative to the frame member 50 until the position of the frame member 54 shown in FIG. 7 is obtained. At that instant, a cam 220 mounted on the shaft 80, for example, actuates momentarily a switch 222. Momentary action of the switch 222 is achieved by providing on the cam 220 a rise of short duration. With the momentary actuation of switch 222, a pulse is applied to the counter 208 for advancing that counter to the next stage. With such advance of the counter 208, a signal is no longer applied to the input 210 of gate 212, and the motor 86 is, thereby no longer operated. The pulse which is applied to the counter 208 by the switch 222, is also applied simultaneously to the bistable switching circuit 216, so as to return this bistable circuit to its initial state.

With the actuation of the counter 208 by the first pulse from the switch 222, a signal is applied to the input 224 of the second AND gate 226. The output of AND gate 226 is applied to operate the motor 178 for lowering the central mattress section 37. However, such operation of the motor 176 will not take place until the switch 218 has been actuated once again to switch the circuit 216 to the opposite state so that a signal is also applied to the second input 228 of the gate 226.

With this arrangement, therefore, each individual step of operation for the driving motors in the sequence of steps to carry out a complete cycle may be controlled in accordance with the convenience of the patient or an attendant carrying out the operations for the benefit of the patient. Thus, the patient is not required to proceed to the next step of operation of the cycle, until the patient feels ready for it.

To aid the patient in determining the next step to be carried out and informing the patient of the steps that already have been carried out, an audio-visual display 230 may be connected to the output of the counter 208. As already noted signals are applied to these outputs of the counter in a predetermined sequence as the counter is progressively pulsed on its input 209. With respective signals applied in sequence to the display 230, different areas or inscriptions may be illuminated, for example, to inform the patient or attendant of the specific step which has been carried out, and to provide information on when the mechanism is in a ready state to proceed to the next step. A buzzer may be included with the display 230 to alert the patient or attendant correspondingly. A return and reset circuit 232 may be actuated by means of a safety switch 234, for example, to step the counter reversibly for the purpose to return the entire arrangement to its initial state of FIG. 6 at any time in the cycle, and upon demand by the patient or attendant.

In a manner similar to that described above in relation to motors 86 and 176, controlling gates 236 and 238 are applied, respectively, for the control of motors 118 and 126. In addition, there are provided gates 240 and 242 to actuate the cleansing device 202 for emitting the water spray and drying air, respectively. Furthermore, each of the motors 118 and 126 include limit switching devices such as the cam 220 and switch 222 described in relation to motor 86. These additional limit switches for motors 118 and 126 have been omitted from the circuit of FIG. 22 for purposes of clarity. In lieu of the cam 220 and switch 222 arrangement, it is also possible to use any one of the other conventional switching devices well known in the art for the purpose of applying a pulse at a predetermined angle of shaft rotation. Thus, electromagnetic and optical devices, well known in the art, can also be used for this purpose.

The switch 218 for actuating and controlling the cycle of operation, in accordance with the present invention, may be simply a single pole switch which is actuated by the hand of the patient, for example, and for this purpose the switch 218 may lie directly on the mattress in the vicinity of the patient's hand. For those patients who lack muscle control in their hands, for example, and cannot actuate the switch 218 in such a manner, can actuate the switch by applying pressure to it in their mouth, for example. For insertion of the switch 218 into the mouth of a patient, the switch 218 may be covered with a jacket 244 made of plastics or rubber so as to be comfortable within the mouth of a patient. In accordance with the design of FIG. 22, for this purpose, the switch 218 has two conductor blades 246 and 248 separated by an insulating layer 250. When the patient bites on the jacket 244, for example, the conductor blades 246 and 248 are brought into electrical contact, and the circuit is closed through conductor leads 252 and 254.

It should be noted that when returning the arrangement of the present invention to the initial state shown in FIG. 6 after a patient has used the toilet, for example, limit switches such as the combination 220, 222 are also required additionally to provide signals when the initial positions of the frame members associated with the respective motors are attained. For this purpose, the counter 208 may be expanded to apply an additional set of resetting signals for operating the motors in reverse. On the other hand, the counter 208 may be operated in reverse with signals emitted by the counter with predetermined polarity, for example, so as to operate the respective motors in reverse directions. The circuitry for operating the counter 208 in this manner, and for reversibly operating the motors, is well known in the art and for this reason, is not described in further detail.

Figure 22:
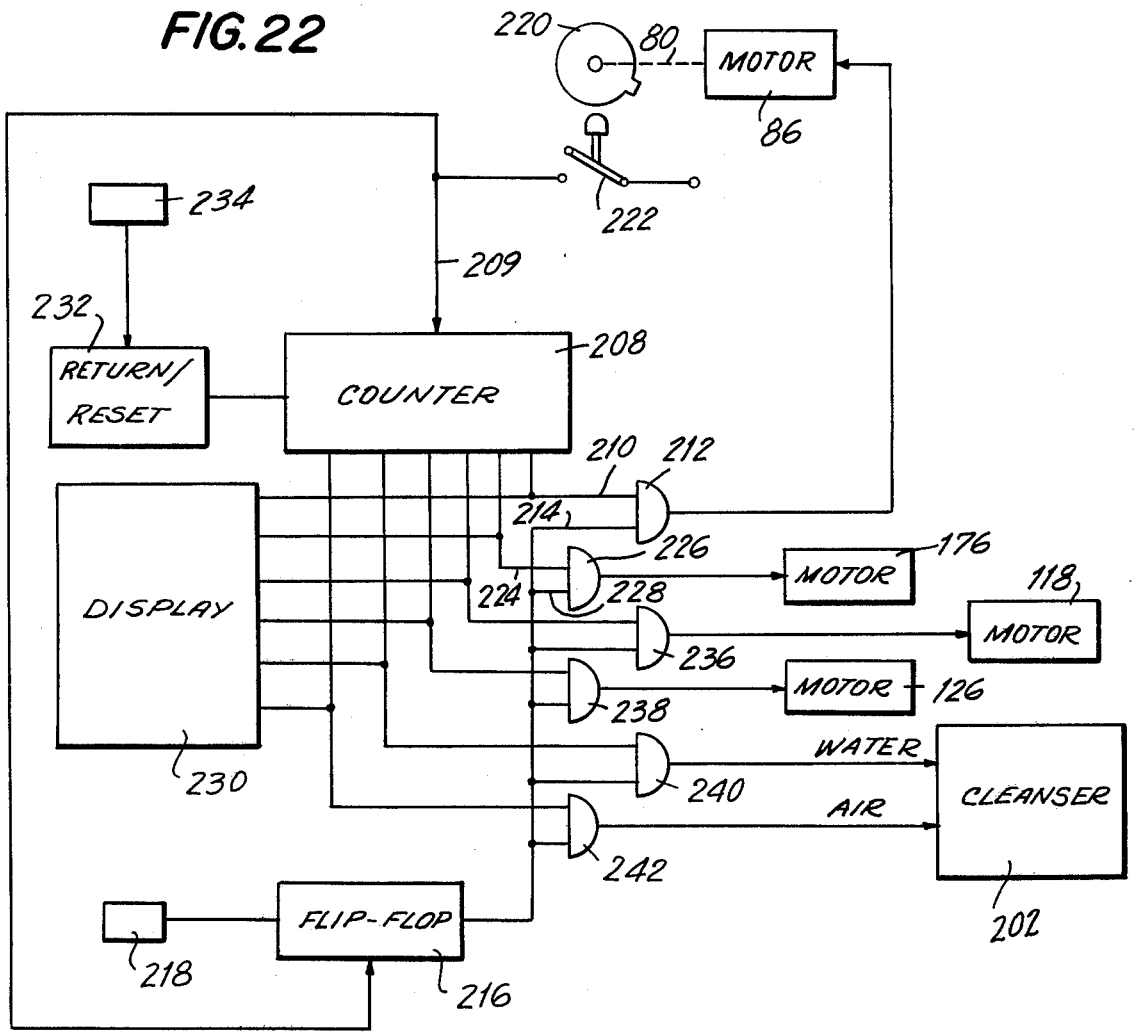
FIG. 22 is a schematic circuit diagram and shows the essential components and their interconnection for controlling the motors for operating the moveable parts of the present invention.
Figure 24:
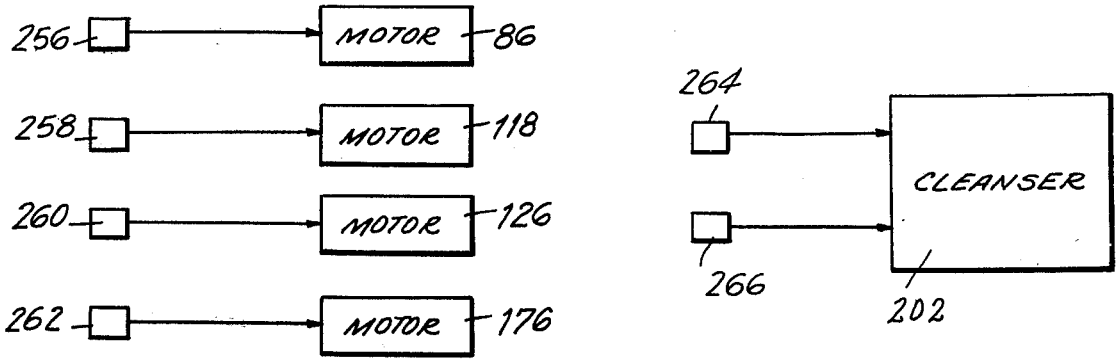
FIG. 24 is a schematic circuit diagram for operating individually the motors of the present invention by manually actuated means.

In conjunction with the circuit of FIG. 22, the respective motors and cleansing apparatus 202 may also be operated individually and independently through isolated manually operated switches 256–266, as shown in the configuration of FIG. 24. The Head section 34 may be raised, for example, at any time to suit the patient's comfort and convenience, at times other than when using the toilet. Similarly, the central section 36 may be raised or inclined to suit a particular patient during relaxation or rest periods. These features are already used in conventional hospital beds, and in accordance with the present invention, these features are obtainable in addition to the particular features which enable a patient to use a toilet, as described, or become placed into a wheelchair.

In accordance with the present invention, furthermore, the patient may be moved from a reclined position into an upright sealed position for purposes of eating, reading, and other activities which persons normally engage in while being seated. To bring the patient into an upright seated position for such purposes, it is only necessary to carry out the steps described supra for placing the patient over a toilet or into a wheelchair. If the toilet is a substantially permanent installation, then the patient can be isolated therefrom by an intermediate seat member, for example, when sitting upright and not using the toilet. Furthermore, when eating, a table can be wheeled over to the patient, and food on the table can be placed directly in front of the patient. Such tables can be similar, for example, to those used in hospitals to wheel the tables over the beds. Such tables are also equipped with means for adjusting the height of the table surface.

The arrangement, in accordance with the present invention, in which the patient is brought into an upright seated position for dining, provides a material advantage over the conventional arrangement prevailing in hospitals, for example. In such conventional arrangement, only the patient's back is elevated to an inclined angle. The patient's legs are generally stretched out corresponding to their position when the patient is reclined. In this conventional arrangement, the patient is not comfortable while dining, since the normal position for persons taking their meals, is an upright seated position with the parts of the legs below the knees directed downward.

The toilet 44, in accordance with the present invention, can be either a permanent installation or a portable unit. A permanent installation has the advantages of permanent plumbing requiring no special maintenance or care in usage. A portable toilet, on the other hand, has the advantage that it can be removed by wheeling it away, for example, when it is not required. Portable toilets, often referred to in the art as chemical toilets, are well known and commercially available. They can be serviced in the conventional manner to clean them for repeated use. Chemicals can be used in conjunction with the portable toilets to eliminate odors, for example. The portable unit can also be in the form of a commode, for example, which is used in conjunction with the wheelchair into which the patient is placed by the present invention.

In the maintenance of the mattress 30, it is desirable to replace or change the central section 36 which is most susceptible to becoming soiled. The replacement or changing of this central section 36 including bed sheets, sanitary covers or disposable covers, is achieved in a particular advantageous manner, in accordance with the present invention, by carrying out the replacement while the patient is in an upright seated position as shown in FIG. 8. In this position, the central section 36 is horizontal and removed from beneath the patient. Accordingly, it is not necessary to move the patient and to counteract the patient's weight for the purpose of replacing the central section 36, since free access to this section can be had when the patient is in the upright seated position.

To allow the use of sufficiently large toilets, the foot section 38, in accordance with the present invention, can be reduced in thickness. By reducing the thickness of this mattress section, for example, additional space prevails between the undersurface of the mattress section 38 and the front rim surface of the toilet bowl 44. This relationship may be seen by referring to FIG. 8. Reduction of the mattress section, for this purpose, is not a disadvantage since the foot section 38 carries the least part of the patient's weight. When reducing the mattress section 38 for this purpose, furthermore, the top surface of the mattress is all at the same level when the patient is reclined, while the lower surface of the mattress includes a step due to the reduced thickness of the foot section.

It is to be noted that it is not essential to remove the central section 36 from the posterior of the patient 32 in the operation of the present invention. The central section 36 may be left in place adjacent to the posterior of the patient, and after obtaining the configuration of FIG. 2, for example, the entire combination of sections 34, 36 and 38 may be rotated about center 48 until the patient 32 becomes seated into an upright position with the lower parts of his legs pointed downwards. During this rotation of the sections 34, 36 and 38 about center 48, these sections maintain the angular relationships to each other as shown in FIG. 2. Once the patient is thus seated upright, the patient may or may not make use of a table, for example.

The arrangement in accordance with the present invention is also useful for applications involving medical examination and medical treatment. In such applications, it may be desirable that the back of the patient be inclined with respect to the horizontal, with the head of the patient lower than the posterior. This position of the patient can be achieved by rotating section 34, with or without sections 36 and 38, until the head of the patient is lower than the posterior as a result of the inclination of the section 34 with respect to the horizontal.

Without further analysis, the foregoing will so fully reveal the gist of the present invention that others can, by applying current knowledge, readily adapt it for various applications without omitting features that, from the standpoint of prior art, fairly constitute essential characteristics of the generic or a specific aspect of this invention, and therefore such adaptations should and are intended to be comprehended within the meaning and range of equivalence of the following claims.

I claim:

1. A method for placing a person onto a toilet from a reclined position comprising the sequentially taken steps of: supporting the back side of the person; moving the calves and thighs of the person in a direction toward the front side of the upper part of the person's body; bending said person's knees; uncovering substantially the posterior of said person, at least part of the weight of said person being directed away from said posterior during uncovering of said posterior; moving a toilet seat in contact with the posterior of said person independent of the toilet, said toilet being stationary when moving said toilet seat; moving said person to an upright seated position; and placing said person over the toilet in seated position with the lower part of the legs directed downwardly, the upper surface of said toilet seat contacting directly the posterior of said person when seated over said toilet, the backside of said person being supported while said person is moved to the seated position.

2. The method as defined in claim 1 wherein the thighs of said person are substantially vertical after the step of moving the thighs of the person in said direction toward the front side of the upper part of the person's body.

3. The method as defined in claim 2 wherein the shin part of the legs of said person are bent substantially at right angles to the thighs after said step of bending said knees.

4. The method as defined in claim 1 including the steps of cleansing the posterior of said person with a fluid and drying thereafter the posterior of said person prior to returning the person to the reclined position.

5. The method as defined in claim 1 including said steps carried out in reverse sequence for returning said person to a reclined position.

6. The method as defined in claim 5 including the step of cleansing the posterior of said person by another person after said first-mentioned person is returned to the position in which said person's knees are bent and the posterior is uncovered.

7. The method as defined in claim 1 including the step of cleansing the posterior of said person after placement of said person over the toilet and completed use of the toilet by said person.

8. The method as defined in claim 1 including the steps of subdividing a bed member into first, second and third sections; reclining said person on said bed member, the first bed member section contacting the posterior of said person, the second bed member section supporting substantially the calves of said person and the third bed member section supporting substantially the back and head of said person; turning said first bed member section for carrying out said step of moving the thighs of the person in a direction toward the front side of the upper part of the person's body; turning said second bed member section for carrying out said step of bending said person's knees; moving said first bed member from contact with the posterior of said person for carrying out said step of uncovering the posterior of said person; and turning said second and third bed member sections together for carrying out said steps of moving said person to said seated position while supporting the backside of said person, and placing said person over a toilet in seated position with the lower part of the legs directed downward;

9. The method as defined in claim 8 including the step of moving said toilet seat from above a toilet bowl to be used by the person.

10. The method as defined in claim 8 wherein said first bed member section is turned about a first center of rotation for carrying out said step of moving the thighs of the person in a direction toward the front side of the upper part of the person's body, said second bed member section being turned about a second center of rotation for carrying out said step of bending said person's knees, said second and third bed members sections being turned together about a third center of rotation for carrying out said steps of moving said person to said seated position and placing said person over said toilet in seated position.

11. A method for transferring a person from a reclined position to an upright seated position comprising the sequentially taken steps of: supporting the backside of the person with the person's posterior at a first location; moving the calves and thighs of the person in a direction toward the front side of the upper part of the person's body; bending said person's knees; freeing substantially the posterior of said person, the weight of said person being directed away from said posterior during freeing thereof; moving thereafter a seating member from a substantially remote location to a location below and in proximity to said posterior; placing said seating member in contact with the posterior of said person, the surface of said seating member contacting the posterior of said person; and moving said person together with said seating member to an upright seated position with the lower part of the legs directed downward while supporting the backside of said person as the person is being moved to the seated position.

12. The method as defined in claim 11 wherein the thighs of said person are substantially vertical after said step of moving the thighs of the person in a direction toward the front side of the upper part of the person's body.

13. The method as defined in claim 12 wherein the shins of the person's legs are bent substantially at right angles to the thighs after said step of bending said person's knees.

14. The method as defined in claim 11 wherein said seating member comprises a toilet seat, said person being seated over a toilet after said step of moving said person together with said toilet seat to the upright seated position.

15. The method as defined in claim 14 including the step of cleansing the posterior of said person after the person has completed use of the toilet.

16. The method as defined in claim 11 including the steps of subdividing a bed member into first, second and third sections; reclining said person on said bed member; the first bed member section contacting the posterior of said person, the second bed member section supporting substantially the calves of said person and the third bed member section supporting substantially the back and head of said person; turning said first bed member section for carrying out said step of moving the thighs of the person in a direction toward the front side of the upper part of the person's body; turning said second bed member section for carrying out said step of bending said person's knees; moving said first bed member from contact with the posterior of said person for carrying out said step of uncovering the posterior of said person; and turning said second and third bed member sections together for carrying out said step of moving said person together with said seating member to an upright seated position.

17. The method as defined in claim 16 wherein said first bed member section is turned about a first center of rotation for carrying out said step of moving the thighs of the person in a direction toward the front side of the upper part of the person's body; said second bed member section being turned about a second center of rotation for carrying out said step of bending said person's knees, said second and third bed member sections being turned together about a third center of rotation for carrying out said step of moving said person together with said seating member to an upright seated position.

18. The method as defined in claim 17 wherein said seating member is attached to a wheelchair.

19. The method as defined in claim 17 wherein said seating member is attached to a chair.

20. The method as defined in claim 11 wherein said seating member is attached to a wheelchair.

21. The method as defined in claim 11 including the step of raising the posterior of said person above the level of said person's head for medical examination and medical treatment after said step of freeing the posterior of said person, the back of said person being inclined with respect to the horizontal with the head lower than said posterior.

22. The method as defined in claim 11 wherein said seating member is attached to a chair.

23. A method for transferring a person from a reclined position to an upright seated position comprising the sequentially taken steps of: supporting the backside of the person with posterior at a first location; moving the calves and thighs of the person in a direction toward the front side of the upper part of the person's body; bending said person's knees; placing seating means in contact with the posterior of said person; at least part of the weight of said person being directed away from said posterior while placing said seating means in contact with the posterior of said person; and moving said person together with said seating means to an upright seated position with the lower part of the legs directed downward the backside of said person being supported while said person is moved to the seated position.

* * * * *